US005943531A

United States Patent [19]

Takai et al.

[11] Patent Number: 5,943,531

[45] Date of Patent: Aug. 24, 1999

[54] ELECTROPHOTOGRAPHIC APPARATUS, IMAGE FORMING METHOD, AND PROCESS FOR FABRICATING LIGHT RECEIVING MEMBER FOR ELECTROPHOTOGRAPHY

[75] Inventors: Yasuyoshi Takai; Yoshio Segi; Hiroyuki Katagiri, all of Nara, Japan

[73] Assignee: Canon Kabushiki Kaisha, Tokyo, Japan

[21] Appl. No.: 08/916,007

[22] Filed: Aug. 21, 1997

[30] Foreign Application Priority Data

Aug. 23, 1996 [JP] Japan ..... 8-222145

[51] Int. Cl.[6] ..... G03G 15/00

[52] U.S. Cl. ..... 399/159; 399/350; 430/56; 430/125

[58] Field of Search ..... 399/159, 343, 399/347, 350, 351, 349, 411; 430/125, 56

[56] References Cited

U.S. PATENT DOCUMENTS

| | | | |
|---|---|---|---|
| 4,380,966 | 4/1983 | Isaka et al. | 118/651 |
| 5,087,542 | 2/1992 | Yamazaki et al. | 430/60 |
| 5,358,811 | 10/1994 | Yamazaki et al. | 430/42 |
| 5,738,963 | 4/1998 | Nino | 430/57 |

FOREIGN PATENT DOCUMENTS

| | | |
|---|---|---|
| 0616260 | 9/1994 | European Pat. Off. . |
| 0679955 | 11/1995 | European Pat. Off. . |
| 0762229 | 3/1997 | European Pat. Off. . |
| 60-144746 | 7/1985 | Japan . |
| 60-168156 | 8/1985 | Japan . |
| 60-178457 | 9/1985 | Japan . |
| 60-225854 | 11/1985 | Japan . |
| 61-231561 | 10/1986 | Japan . |

OTHER PUBLICATIONS

Database WPI, Section Ch, Week 9102, Derwent Publ., AN91–011164; XP002071497 of JP02–284163.

*Primary Examiner*—Richard Moses

*Attorney, Agent, or Firm*—Fitzpatrick, Cella, Harper & Scinto

[57] ABSTRACT

For maintaining good cleanability even in use of low-melting-point or small-particle-diameter toner, thereby achieving a breakthrough improvement in the quality of image, the following conditions are satisfied:

$0.001 \leqq x/y \leqq 0.1$, $30 \leqq a/x \leqq 200$, and $0.1 \leqq a/y \leqq 3$ (x: height of unevenness, y: pitch of unevenness, a: particle diameter of toner).

26 Claims, 7 Drawing Sheets

ELECTROPHOTOGRAPHIC APPARATUS, IMAGE FORMING METHOD, AND PROCESS FOR FABRICATING LIGHT RECEIVING MEMBER FOR ELECTROPHOTOGRAPHY

BACKGROUND OF THE INVENTION

1. Field of the Invention

The present invention relates to an electrophotographic apparatus, an image forming method utilizing the electrophotographic process, and a process for fabricating a light receiving member for electrophotography used in the apparatus or in the forming method. More particularly, the present invention relates to an electrophotographic apparatus provided with a light receiving member for electrophotography having a surface of a non-monocrystal material comprising at least carbon, an image forming method using the photosensitive member, and a process for fabricating the light receiving member for electrophotography.

2. Related Background Art

In an image forming apparatus arranged to repeat a step of transferring a transferable toner image, formed on the surface of the light receiving member for electrophotography, to a transfer medium such as paper, the residual toner remaining on the surface of light receiving member after transfer is removed by a cleaning means.

The principal purpose of the cleaning process in the electrophotographic apparatus is to clean the surface of light receiving member by removing a residual image on the surface of light receiving member, i.e., by removing the toner (developer) remaining on the surface of light receiving member, for preparation for the next copying operation.

The known cleaning methods of the surface of light receiving member include the blade method, the fur brush method, the magnet brush method, and so on.

The blade method is a method for making a blade with elasticity like urethane rubber contact the surface of the light receiving member under rotation to remove the residual toner from the surface of light receiving member, which is used most popularly as a cleaning method because of its characteristics including feasibility of compact arrangement of the device for cleaning, relatively wide tolerance of setting conditions of device, and so on. A cleaning means of this type widely used heretofore is a cleaning blade of an elastic material such as rubber.

There are, however, some cases wherein use of only this cleaning blade is not always effective in removing deposits or the like such as fused toner, paper dust, rosin, or talc, fused and stuck to the surface of photosensitive member.

Proposed for compensating for incompleteness of the cleaning blade was a cleaning device arranged to remove the various deposit materials described above by urging a cleaning roller of an elastic material such as silicone rubber against the surface of photosensitive member and making the roller slide thereon.

There are cleaning devices proposed with use of either a magnetic cleaning roller composed of a sliding roller and a magnetic member, a cleaning roller to which a bias in the opposite polarity to the toner is applied, or a cleaning roller arranged so that the cleaning roller itself becomes the opposite polarity to the toner, and in such an arrangement that the cleaning roller is urged against the surface of photosensitive member and is made to slide thereon, thereby removing the various deposit materials described above.

The cleaning roller, as described above, is disposed in the cleaning device and a scraper is placed in contact therewith.

The scraper is arranged to force the toner collected in the cleaning device (which will be referred to as collected toner) down into a collected toner reserving section with rotation of the cleaning roller, to coat the surface of cleaning roller with part of the collected toner, and to slidingly polish the surface of photosensitive member with the collected toner adhering to the coating surface, thereby slidingly removing the foreign materials described above and the powder such as the toner from the surface of photosensitive member.

A very effective means for achieving the good cleaning effect is to weaken adhesion of the residual toner adhering to the surface of light receiving member, in removing the residual toner from the surface of light receiving member by these cleaning methods.

In general, the toner on the surface of light receiving member adheres onto the surface of light receiving member by electrostatic force (Coulomb force and mirror reflection force) and van der Waals force. The adhesion by the electrostatic force can be relieved by eliminating electrical charge from the residual toner or the like, and the adhesion due to the van der Waals force can be relieved by a method of increasing the hardness of the surface of light receiving member or by a method for controlling the surface roughness or the like.

An example of the technology noting this point is the bulletin of Japanese Patent Application Laid-open No. 60-144746. This bulletin discloses the technology in which the surface of photosensitive member (=light receiving member) for electrophotography is made of an amorphous material containing silicon atoms and the surface is roughened so as to make the pitch and depth of unevenness of the surface of photosensitive member smaller than the average particle diameter of the developer to decrease the adhesion of toner, thereby enhancing cleanability.

This technology enabled to clean off the toner remaining on the surface of light receiving member down to some good level.

With demands for quicker copying speeds of copier or for further higher quality of copy image in recent years, however, it became necessary to control the surface condition of light receiving member more precisely.

Specifically, low-melting-point and small-particle-diameter toner materials are being used from the following reasons.

(1) The low-melting-point toner capable of being melted and fixed quicker than before was developed for fixing the toner quicker on the surface of transfer sheet to meet the demand for higher copy speed of copier.

(2) Finer toner than before, i.e., the small-particle-diameter toner was developed for meeting the demand for higher quality of image.

However, such low-melting-point and small-particle-diameter toner materials enable quicker copying and higher quality of image of copier on one hand, but they have a problem that they make cleaning harder on the other hand.

For example, the lower melting point raises the problem that fusion of toner to the surface of light receiving member becomes easier to occur than heretofore. Especially, in the case of an electrophotographic apparatus wherein the photoconductive layer is of a non-monocrystal material containing hydrogen atoms and/or halogen atoms in the matrix of silicon atoms, i.e., wherein an amorphous silicon (hereinafter referred to as a-Si) based light receiving member is used for the photoconductive layer, a drum heater is provided in the copier, whereby the surface temperature of the photosensitive member is controlled at about 40° C. for preventing smearing of image (for example, Japanese Patent Application Laid-open No. 60-95551). Because of this, the surface temperature of light receiving member might increase to cause the residual toner to be fused to the surface of light receiving member in the image forming step, for example, at the start after long-term stop.

Even in the event of continuous operation, there are cases wherein the surface temperature increases as the surface of light receiving member is exposed to charge and exposure, so that the residual toner is also fused onto the surface of light receiving member.

With use of the small-particle-diameter toner, because the specific surface area thereof is larger than that of normal particle-diameter toner and because adhesion to the surface of light receiving member thus becomes greater, it makes harder to remove the residual toner from the surface of light receiving member than in the case of the normal particle-diameter toner. Accordingly, in the case of the low-melting-point plus small-particle-diameter toner, the possibility of occurrence of fusion to the surface of light receiving member becomes higher.

There thus occurred some cases wherein it became difficult to remove the residual toner or the fused toner well even with combined use of the cleaning blade and cleaning roller.

Repetition of copying processes in this state could result in notable occurrence of image defects such as "black dots", "white dots" or "black lines", "image unevenness" or the like, thus making it difficult to maintain the initial image quantity for a long term.

SUMMARY OF THE INVENTION

An object of the present invention is to solve the various problems as described above.

Specifically, an object of the present invention is to provide an electrophotographic apparatus that achieves a breakthrough improvement in the quality of image by maintaining good cleanability even in use of the low-melting-point toner or the small-particle-diameter toner, an image forming method therewith, and a process for fabricating a light receiving member that can be used in the photoelectric apparatus or in the image forming method.

Another object of the present invention is to provide an electrophotographic apparatus and an image forming method using a light receiving member the surface condition of which is controlled by controlling the ratio of the discharge power to the flow rate of source gas (raw-material gas) and the ratio of source gas flow rate to dilution gas flow rate, being fabrication conditions of the light receiving member, in respectively specific ranges, and to provide a process for fabricating the light receiving member.

A further object of the present invention is to provide a process for fabricating a light receiving member for electrophotography with a light receiving layer made of a non-monocrystal material the matrix of which is silicon atoms, substantially always stable in electric, optical, and photoconductive characteristics almost independently of operation circumstances, excellent in photofatigue resistance, excellent in durability and humidity resistance without causing deterioration in repetitive operations, showing little observation of residual potential, and exhibiting high quality of image.

A further object of the present invention is to provide an electrophotographic apparatus comprising a light receiving member for formation of a latent image and means for supplying toner to a surface of the light receiving member, wherein the surface of the light receiving member has unevenness and the unevenness satisfies $0.001 \leqq x/y \leqq 0.1$, $30 \leqq a/x \leqq 200$, and $0.1 \leqq a/y \leqq 3$, where x is a height of the unevenness of the surface, y is a pitch of the unevenness of the surface, and a is a particle diameter of the toner.

A further object of the present invention is to provide an image forming method comprising charging a surface of a light receiving member having unevenness in the surface, irradiating the thus charged surface with desired light to form a latent image therein, and supplying toner to the surface in which the latent image is formed, thereby forming an image on the surface of the light receiving member, wherein the unevenness satisfies $0.001 \leqq x/y \leqq 0.1$, $30 \leqq a/x \leqq 200$, and $0.1 \leqq a/y \leqq 3$, where x is a height of the unevenness, y is a pitch thereof, and a is a particle diameter of the toner.

A further object of the present invention is to provide a process for fabricating a light receiving member for electrophotography comprising an electroconductive substrate, a photoconductive layer made of a non-monocrystal material containing hydrogen atoms or halogen atoms in the matrix of silicon atoms and showing photoconductivity, and a surface layer of a non-monocrystal material containing at least silicon atoms and at least one species selected from the group consisting of carbon atoms, oxygen atoms, and nitrogen atoms, wherein the photoconductive layer is made so that (A), (B1), (B2), (C), (D), and (E) satisfy the following conditions:

$C = A \times B1$ $C = E \times B2$ $1.2 \leqq B1 \leqq 6.0$ $0.01 \leqq B2 \leqq 0.06$ $3 \leqq D/A \leqq 10$ where (A) is a flow rate of source gas, (B1) is multiplier 1, (C) is discharge power, (D)) is a flow rate of dilution gas, (E) is a volume of a discharge space, and (B2) is multiplier 2.

DETAILED DESCRIPTION OF THE PREFERRED EMBODIMENTS

The present invention provides the electrophotographic apparatus and image forming method achieving the breakthrough improvement in the quality of image by maintaining the good cleanability even in use of the low-melting-point toner or the small-particle-diameter toner.

The effects achieved by the present invention will be described.

First, the adhesion of the toner to the surface of light receiving member is decreased, so that the toner becomes harder to remain on the surface of light receiving member.

As described previously, the toner remaining on the surface of light receiving member adheres onto the surface of light receiving member by the electrostatic force (the Coulomb force and mirror reflection force) and the van der Waals force. Therefore, the adhesion can be controlled by controlling the surface property of the light receiving member, depending upon the particle diameter of toner used. Specifically, the adhesion is restricted well by providing the surface of light receiving member with specific unevenness according to the particle diameter of toner used, so as to well control the contact area between the toner and the surface of light receiving member.

This mechanism will be detailed in the following referring to FIGS. 1A and 1B and FIGS. 2A and 2B. In these figures each numeral 301 or 401 denotes the outermost layer of the light receiving member, 302 or 402 a cleaning blade, 303 the toner, and 403 the toner aggregate.

Figure 1A:
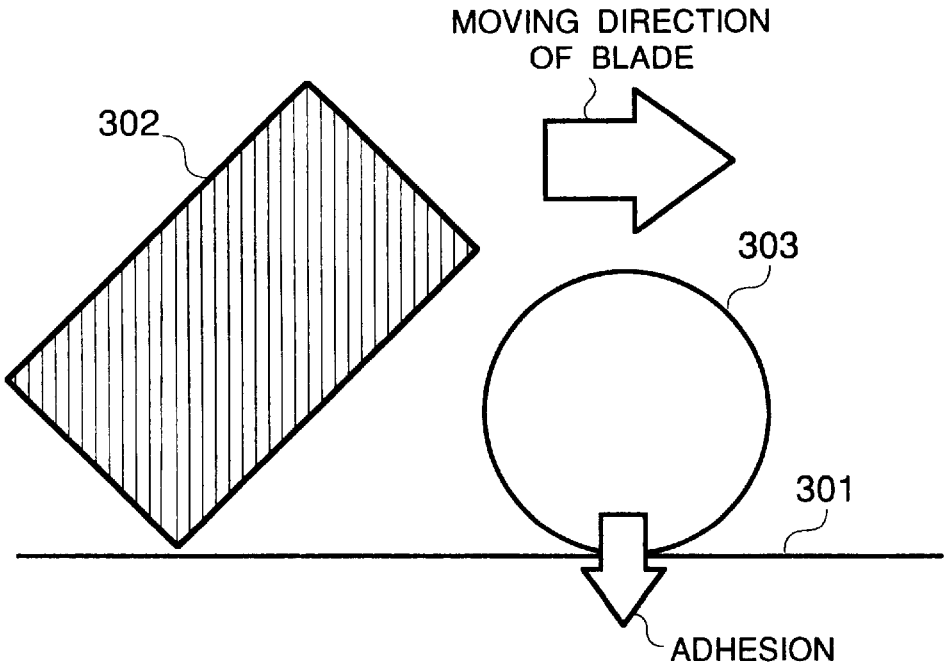
FIG. 1A and FIG. 1B are schematic, explanatory views each of which is for explaining the mechanism for removing a toner carrier adhering to the surface of the light receiving member for electrophotography.
Figure 1B:
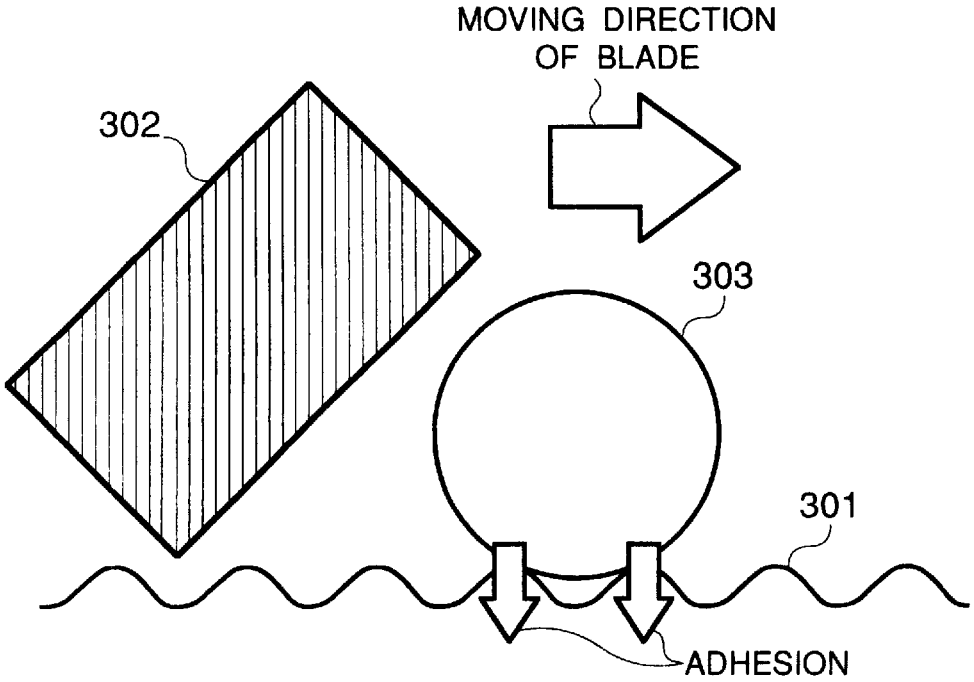
Figure 2A:
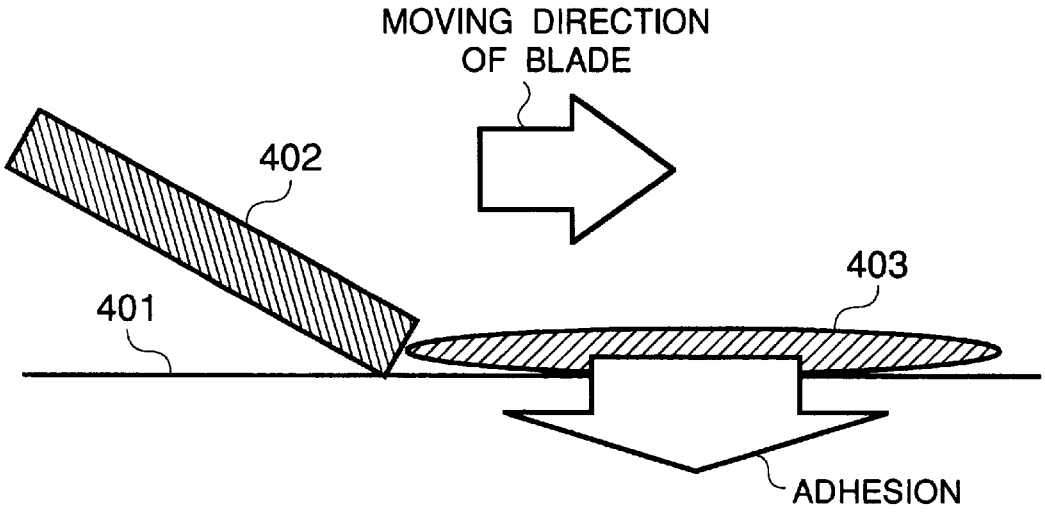
FIG. 2A and FIG. 2B are schematic, explanatory views each of which is for explaining the mechanism for removing toner aggregate adhering to the surface of the light receiving member for electrophotography.
Figure 2B:
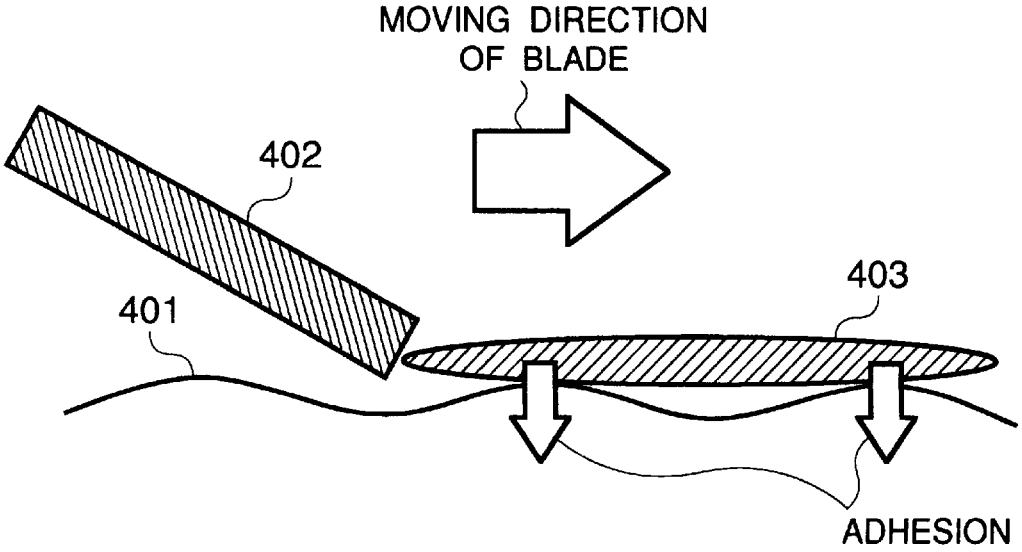

FIG. 1A is a schematic diagram to show a state in which a toner particle adheres onto the light receiving member with a flat surface, FIG. 1B is a schematic diagram to show a state in which a toner particle adheres onto the light receiving member with the unevenness satisfying the conditions of the present invention, FIG. 2A is a schematic diagram to show a state in which the toner aggregate adheres onto the light receiving member with a flat surface, and FIG. 2B is a schematic diagram to show a state in which the toner aggregate adheres onto the light receiving member with having the unevenness satisfying the conditions of the present invention.

When the surface of light receiving member is flat as shown in FIG. 1A, the adhesion is so strong that the cleaning blade may fail to remove the toner well in some cases. When the unevenness is provided so as to satisfy the conditions of the present invention in the surface of light receiving member as shown in FIG. 1B, the contact area is decreased and the adhesion of toner is thus decreased, which can decrease a rate of occurrence of residual toner.

In the event wherein the toner remains in a state of single toner particles on the surface of light receiving member without being removed and wherein the remaining toner aggregates and melts to start forming nuclei of fusion, the adhesion of the toner aggregate is often strong enough to make removal by the cleaning blade difficult in the case of the flat surface of light receiving member as shown in FIG. 2A; whereas, by controlling the surface of the light receiving member in the specific ranges of the present invention as shown in FIG. 2B, the toner aggregate is removed before it grows into the size that can be recognized by human vision.

Second, the contact between the surface of light receiving member and the cleaning blade is improved. Specifically, even if the adhesion of the residual toner on the light receiving member is decreased to some extent, but unless matching with the cleaning blade is achieved, the residual toner will not always be removed sufficiently.

For example, if the unevenness of the surface of light receiving member is far smaller than the optimum range of the present invention, the contact area will increase between the cleaning blade and the surface of light receiving member to increase the frictional resistance more than necessary during movement of the cleaning blade on the surface of light receiving member. This will increase the difference in the frictional resistance between a toner-remaining portion and a toner-removed portion, which would sometimes cause nonuniform cleaning. Further, there are some cases wherein the cleaning blade fails to scrape the residual toner well, but on the contrary, it coats the surface of the light receiving member with a thin layer of toner (especially, a filler or the like such as a wax component in the toner) by pressure and frictional heat between the cleaning blade and the surface of light receiving member.

On the other hand, if the unevenness of the surface of light receiving member is far greater than the optimum range of the present invention, the unevenness will damage the cleaning blade itself, so as to fail to achieve the cleaning effect expected, in some cases. When the contact between the surface of light receiving member and the cleaning blade is in the optimum range, the cleaning blade then slides on the surface of light receiving member smoothly without catch, thus enhancing the toner collecting effect.

It is conceivable that the cleaning effect for the low-melting-point/small-particle-diameter toner can be enhanced by mainly imparting the two effects described above to the surface of light receiving member.

The surface property to achieve the effects of the present invention will be described in detail with FIG. 3 and FIG. 4.

Figure 3:
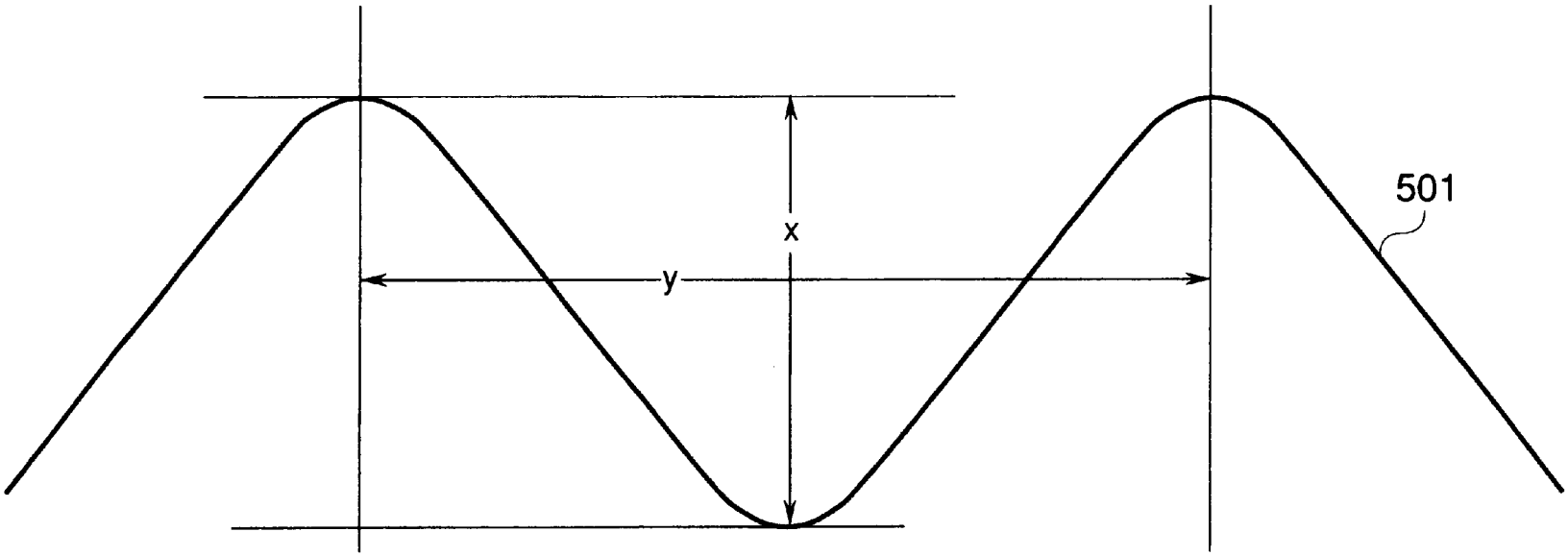
FIG. 3 and FIG. 4 are schematic, explanatory views each of which is for explaining an example of the uneven shape of the surface of light receiving member for electrophotography.
Figure 4:
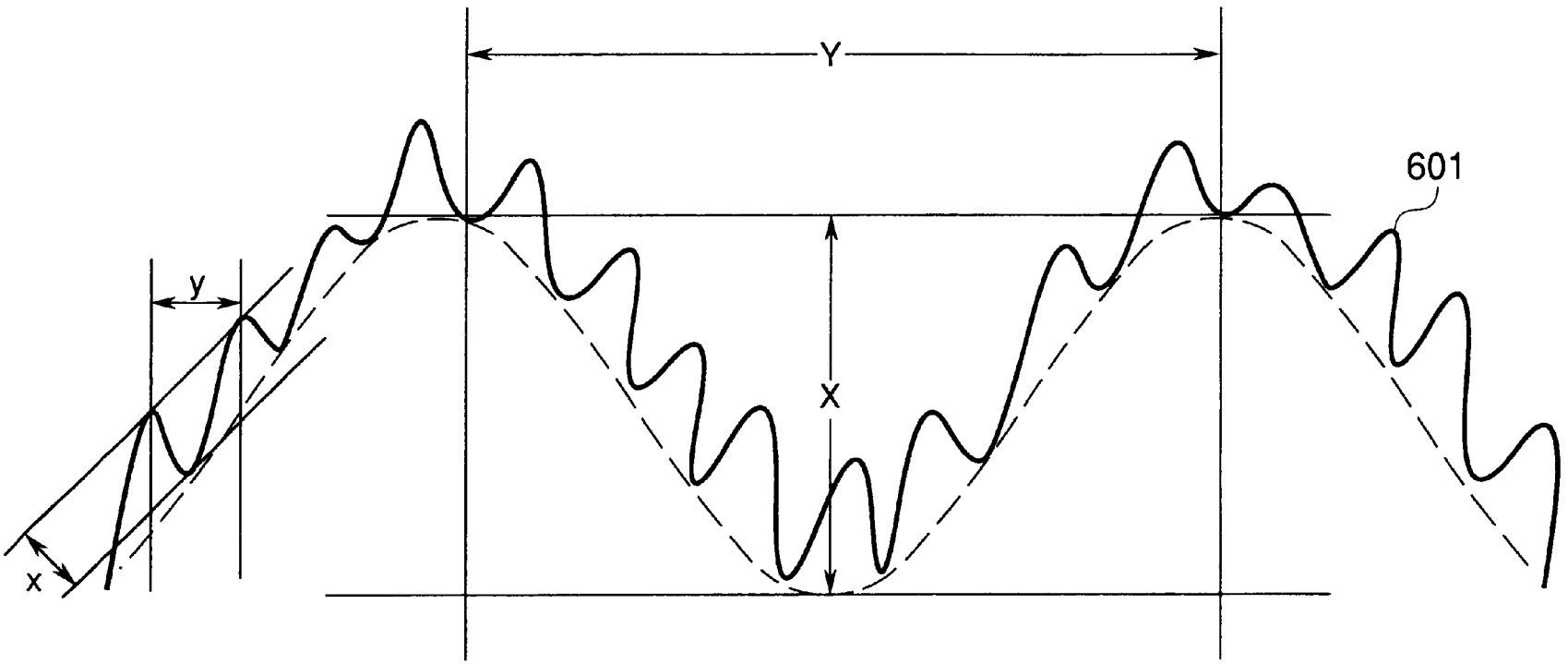

FIG. 3 schematically shows a form of unevenness in the surface of light receiving member according to the present invention. FIG. 4 also schematically shows another form of unevenness (an example of combination of plural unevenness patterns) in the surface of light receiving member according to the present invention.

In these figures each numeral 501 or 601 denotes the surface of light receiving member. Further, x and y represent the height and pitch, respectively, of first unevenness, and X and Y the height and pitch, respectively, of second unevenness. The height of unevenness is a distance from the bottom of a depressed part to the top of a projected part and the pitch of unevenness is a distance between tops of projected parts or between bottoms of depressed parts.

According to the finding of the inventors, when the particle diameter (average particle diameter) of the toner used is a, relations with x and y are preferably in the following ranges:

$$0.001 \leqq x/y \leqq 0.1 \quad (1),$$

$$30 \leqq a/x \leqq 200 \quad (2),$$

$$0.1 \leqq a/y \leqq 3 \quad (3);$$

more preferably in the following ranges:

$$0.002 \leqq x/y \leqq 0.08 \quad (4),$$

$$40 \leqq a/x \leqq 180 \quad (5),$$

$$0.2 \leqq a/y \leqq 2 \quad (6);$$

most preferably in the following ranges:

$$0.003 \leqq x/y \leqq 0.05 \quad (7),$$

$$50 \leqq a/x \leqq 150 \quad (8),$$

$$0.3 \leqq a/y \leqq 1 \quad (9).$$

At this time x and y are preferably in the following ranges:

$$0.05\ \mu m \leqq x \leqq 5\ \mu m \quad (10)$$

$$1\ \mu m \leqq y \leqq 100\ \mu m \quad (11).$$

When the unevenness is composed of plural types of unevenness as exemplified in FIG. 4, when the height and pitch of first unevenness are denoted by x and y, respectively, and when the height and pitch of second unevenness are denoted by X and Y, respectively, relations of x, y and X, Y are preferably in the following ranges:

$$0.3 \leqq x/X \leqq 0.7 \quad (12)$$

$$0.1 \leqq y/Y \leqq 0.3 \quad (13)$$

As for the control of these unevenness patterns, heights and pitches of all unevenness portions do not always have to be uniform, but a sufficient condition is that average values, for example, at ten points are in the above ranges.

(As regards forming conditions)

The following can be considered as to the forming conditions for controlling the surface property of the light receiving member.

When the photoconductive layer is formed by a special forming method such as the plasma enhanced CVD process, the unevenness of surface reflects delicate forming conditions. Specifically, the state of unevenness also changes with change in a plasma state upon formation of a deposit film.

For example, almost all forming conditions of the photoconductive layer including an absolute value of discharge power, gas flow rates, the temperature of substrate, and so on are considered to affect generation of unevenness in some form. Specifically, as to the gas flow rates, increase or decrease in the gas flow rates changes the structure of the film into the columnar structure or the like or changes the density of film to make either a dense film or a coarse film.

In the present invention, the surface property of the light receiving member is controlled by maintaining relations of the source gas flow rate and the discharge power, of discharge power input per unit discharge space, and of mixture ratio of source gas and dilution gas flow rates in respectively specific ranges.

Control of these parameters is considered to control the decomposition process of source gas in the plasma so as to effect optimum control of types and ratios of ions, radicals, electrons, etc. (hereinafter referred to as active species).

It is thought that the forming conditions are such that optimum coupling is promoted, for example, by compensation for dangling bonds, activation of surface, generation of bound bonds, and increase of the temperature of the outermost surface and that construction of three-dimensional network structure having optimum unevenness occurs effectively.

Accordingly, by such control of the relations of the source gas flow rate and the discharge power, of the discharge power input per unit discharge space, and of the mixture ratio of source gas and dilution gas flow rates as to effectively achieve the construction of three-dimensional network structure having the optimum unevenness by the dilution gas plasma, a deposit film having less structural disorder and having the optimum unevenness in the outermost surface is stacked, so as to reduce the adhesion of toner onto the surface of light receiving member and also improve matching with the cleaning blade, thus remarkably improving the cleaning effect. As a consequence, even if the copying process is repeated for a long period with use of the low-melting-point toner or the small-particle-diameter toner, the image defects such as "black dots", "white dots" or "black lines" or generation of "image unevenness" or the like will be suppressed on copy images, which will enhance stability of photosensitive member against operation circumstances. Therefore, images can be obtained stably with high quality of clear halftones and high resolution, conceivably.

An example of effective toner exhibiting the outstanding effects of the present invention is insulating toner comprising at least a binding resin. The binding resin may be selected, for example, from homopolymers of styrene and substitutes thereof such as polystyrene, poly-p-chlorostyrene, or polyvinyltoluene; styrene based copolymers such as styrene-p-chlorostyrene copolymer, styrene-vinyltoluene copolymer, styrene-vinylnaphthalene copolymer, styrene-acrylic ester copolymer, styrene-α-chloro methyl methacrylate copolymer, styrene-acrylonitrile copolymer, styrene-vinyl methyl ether copolymer, styrene-vinyl methyl ketone copolymer, styrene-butadiene copolymer, styrene-isoprene copolymer, styrene-acrylonitrile-indene copolymer; polyvinyl chloride, phenol resin, natural-resin-modified maleic resin, acrylic resin, methacrylic resin, polyvinyl acetate resin, silicone resin, polyester resin, polyurethane, polyamide resin, furan resin, polyvinyl butyral, epoxy resin, xylene resin, terpene resin, coumarone-indene resin, petroleum resin, and so on.

The toner used in the present invention is made by mixing a coloring agent in the binding resin described above. The coloring agent may be magnetic powder, a pigment, a dye, or the like. The magnetic powder may be selected, for example, from metals such as iron, nickel, copper, manganese, chromium, or rare earth metals and alloys thereof, the surface of which is oxidized or unoxidized, or from oxides thereof and ferrite. An example of the pigment is carbon black.

In addition to these components, the toner is used preferably with an additive of lubricant for improving flowability of toner, for example, with a material of $SiO_2$, strontium titanate, cerium oxide, or the like.

Next described is an example of the forming conditions of the light receiving member that can be used suitably for the present invention.

According to the finding of the inventors, in formation of the photoconductive layer, when the flow rate of source gas introduced into a film-forming chamber is (A), multiplier 1 is (B1), the discharge power is (C), the flow rate of dilution gas introduced into the film-forming chamber is (D), the volume of the discharge space in the film-forming chamber is (E), and multiplier 2 is (B2), there are the following relations among (A), (B1), (B2), (C), (D), and (E): supposing $$C = A \times B1 \quad (14),$$

$$C = E \times B2 \quad (15);$$

preferably, the following conditions are satisfied:

$$1.2 \leqq B1 \leqq 6.0 \quad (16),$$

$$0.01 \leqq B2 \leqq 0.06 \quad (17),$$

$$3 \leqq D/A \leqq 10 \quad (18);$$

more preferably, the following conditions are satisfied:

$$1.3 \leqq B1 \leqq 5 \quad (19),$$

$$0.01 \leqq B2 \leqq 0.05 \quad (20),$$

$$3.5 \leqq D/A \leqq 8 \quad (21);$$

most preferably, the following conditions are satisfied:

$$1.4 \leqq B1 \leqq 4.5 \quad (22),$$

$$0.01 \leqq B2 \leqq 0.03 \quad (23),$$

$$4 \leqq D/A \leqq 7 \quad (24).$$

In making the surface layer of the non-monocrystal material containing at least silicon atoms and at least one species selected from carbon atoms, oxygen atoms, and nitrogen atoms, when (F) represents the flow rate of CON-introducing source gas for introducing at least one species selected from carbon atoms, oxygen atoms, and nitrogen atoms, (G) a multiplier, and (H) the discharge power, (F), (G), and (H) are controlled preferably in the following ranges:

$$H = F \times G \quad (25),$$

and $$0.2 \leqq G \leqq 0.7 \quad (26),$$

to enhance the water repellency of surface, which enhances the effects of the present invention more remarkably.

The present invention will be described in detail with reference to the drawings.

Figure 5A:
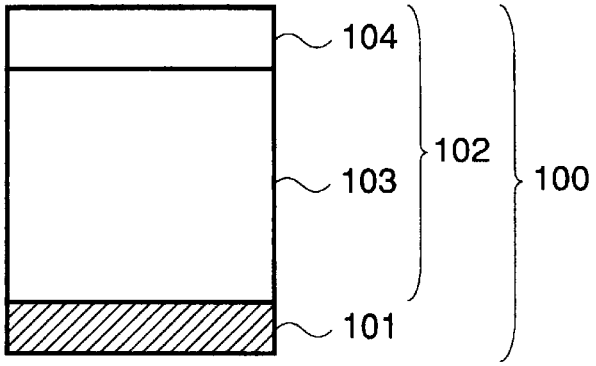
FIG. 5A, FIG. 5B and FIG. 5C are schematic, cross-sectional views each of which is for explaining an example of the layer structure of the light receiving member for electrophotography.
Figure 5B:
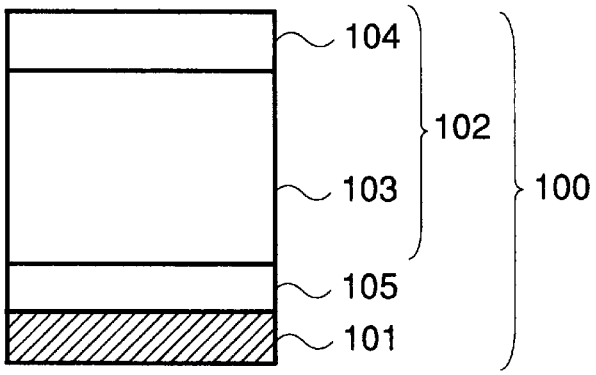
Figure 5C:
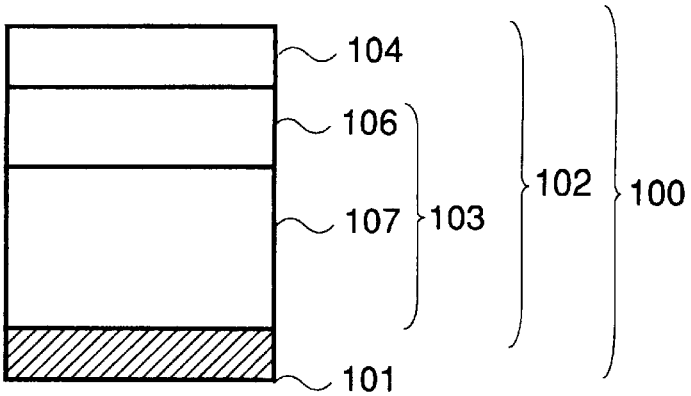

FIGS. 5A–5C are schematic, structural views, each illustrating an example of the layer structure of the light receiving member for electrophotography that can be employed in the present invention.

The light receiving member for electrophotography 100 shown in FIG. 5A has the light receiving layer 102 on the substrate 101 for light receiving member. The light receiving layer 102 has a photoconductive layer 103 with photoconductivity of an amorphous material containing at least either hydrogen atoms or halogen atoms in the matrix of silicon atoms (a-Si: H, X), and an amorphous silicon based surface layer 104.

FIG. 5B is a schematic, structural diagram for explaining another layer structure of the light receiving member for electrophotography according to the present invention. The light receiving member for electrophotography 100 shown in FIG. 5B has the light receiving layer 102 on the substrate 101 for light receiving member. The light receiving layer 102 has an amorphous silicon based charge injection preventing layer 105, a photoconductive layer 103 with photoconductivity of a-Si: H, X, and an amorphous silicon based surface layer 104 in the named order from the substrate 101 side.

FIG. 5C is a schematic, structural diagram for explaining still another layer structure of the light receiving member for electrophotography according to the present invention. The light receiving member for electrophotography 100 shown in FIG. 5C has the light receiving layer 102 on the substrate 101 for light receiving member. The light receiving layer 102 has a charge transport layer 107 of a-Si: H, X and a charge generation layer 106 of a-Si: H, X, which constitute the photoconductive layer 103, and an amorphous silicon based surface layer 104 in the named order from the substrate 101 side.

(Substrate)

The substrate 101 used in the present invention may be either electrically conductive or electrically insulative. Examples of electrically conductive substrates are those of metals such as Al, Cr, Mo, Au, In, Nb, Te, V, Ti, Pt, Pd, or Fe, and alloys thereof, for example stainless steel or the like. The substrate may also be one obtained by selecting one from electrically insulating substrates of glass, ceramics, and films or sheets of synthetic resins such as polyester, polyethylene, polycarbonate, cellulose acetate, polypropylene, polyvinyl chloride, polystyrene, and polyamide and by subjecting the surface thereof, at least on the side where the light receiving layer is made, to an electroconductive treatment.

The substrate 101 used in the present invention may be of a cylindrical or plate-shaped endless belt having a smooth or uneven surface. The thickness of the substrate is determined properly so as to permit the light receiving member for electrophotography 100 to be made as desired. When flexibility is required for the light receiving member for electrophotography 100, the substrate 101 can be made as thin as possible within the range wherein the function as the substrate 101 can be demonstrated fully. However, the thickness of the substrate 101 is normally determined to be preferably not less than 10 $\mu$m from the reasons of manufacturing, handling, mechanical strength, and so on.

Especially, when image recording is carried out with coherent light such as laser light, the surface of substrate 101 may be provided with unevenness for effectively canceling image failure due to so-called interference fringe patterns appearing in a visible image. The unevenness provided in the surface of substrate 101 is made by either one of well known methods described in Japanese Patent Application Laid-open Nos. 60-168156, 60-178457, 60-225854, and so on.

Another method for effectively canceling the image failure due to the interference fringe patterns in use of the coherent light such as the laser light is a method for providing the surface of substrate 101 with an uneven shape comprised of a plurality of spherical trace depressions. Namely, the surface of the substrate 101 has finer unevenness than the resolution demanded for the light receiving member for electrophotography 100 and the unevenness is of the plurality of spherical trace depressions. The unevenness by the plurality of spherical trace depressions provided in the surface of substrate 101 is made by the conventional method described in Japanese Patent Application Laid-open No. 61-231561.

(Photoconductive layer)

In the present invention, the photoconductive layer 103, which is made on the substrate 101 in order to effectively achieve the objects of the present invention and constitute a part of the light receiving layer 102, is made by a vacuum deposit film producing method according to the present invention and under setting of numerical conditions of film-forming parameters. Specifically, it can be made by a glow discharge process (an AC discharge CVD process such as the low-frequency CVD process, the high-frequency CVD process, or the microwave CVD process, or a DC discharge CVD process, or the like).

For effectively performing the treatment of the outermost surface film-formed, which is the effects of the present invention, the relations of the source gas flow rate and discharge power, the discharge power input per unit discharge space, and the mixture ratio of source gas and dilution gas flow rates are controlled in the specific ranges as described above, whereby the surface property of the light receiving member can be controlled, thus achieving the breakthrough improvement in cleanability of the surface of light receiving member, which is the object of the present invention.

For making the photoconductive layer 103 by the glow discharge process, basically, the source gas for supply of Si capable of supplying silicon atoms (Si), the dilution gas for supply of H capable of supplying hydrogen atoms (H), and the source gas for supply of X capable of supplying halogen atoms (X) are introduced in a desired gas state into the reaction vessel, the internal pressure of which can be reduced, and glow discharge is made to take place in the reaction vessel, whereby the layer of a-Si: H, X is made on the predetermined substrate 101 preliminarily set at a predetermined position.

The hydrogen atoms are structurally introduced into the photoconductive layer 103 thus made, and an example of the dilution gas introduced for controlling the introducing ratio of hydrogen atoms is $H_2$ as an effectively used gas. In addition, He gas may be mixed as a dilution gas into the reaction vessel.

In the present invention the photoconductive layer 103 preferably contains the atoms for controlling the conductivity type as occasion may demand. The atoms for controlling the conductivity type may be contained in a uniformly distributed state all around in the photoconductive layer 103 or may be contained in a nonuniformly distributed state in some portions in the direction of film thickness.

Specific examples of the atoms for controlling the conductivity type are so-called impurities in the semiconductor fields, more specifically, the atoms giving the p-type conduction characteristic and belonging to Group IIIb in the periodic table (hereinafter referred to as "IIIb-atoms") or the atoms giving the n-type conduction characteristic and belonging to Group Vb in the periodic table (hereinafter referred to as "Vb-atoms").

Specific examples of the IIIb-atoms are boron (B), aluminum (Al), gallium (Ga), indium (In), thallium (Tl), and so on and particularly, B, Al, and Ga are preferably applicable. Specific examples of the Vb-atoms are phosphorus (P), arsenic (As), antimony (Sb), bismuth (Bi), and so on and particularly, P and As are preferably applicable.

For structurally introducing the atoms for controlling conductivity type, for example, the IIIb-atoms or the Vb-atoms, into the photoconductive layer, the raw-material substance for introduction of the IIIb-atoms or the raw-material substance for introduction of the Vb-atoms is introduced in a gas state together with the other gas for making the photoconductive layer 103 into the reaction vessel, upon formation of layer. The raw-material substance for introduction of the IIIb-atoms or the raw-material substance for introduction of the Vb-atoms is desirably selected from those existing in a gas state at ordinary temperature and under ordinary pressure and those that can be gasified readily at least under the conditions for forming the layer.

Specific examples of the raw-material substance for introduction of the IIIb-atoms are boron hydrides such as $B_2H_6$ and $B_4H_{10}$ and boron halides such as $BF_3$, $BCl_3$, and $BBr_3$ for introduction of boron atoms. Other examples are $AlCl_3$, $GaCl_3$, $Ga(CH_3)_3$, and so on. Among them, $B2H_6$ diluted with hydrogen is most preferably used in terms of bringing out the effects of the present invention more effectively and handling.

Specific examples effectively applicable as the raw-material substance for introduction of the Vb-atoms are phosphorus hydrides such as $PH_3$ and $P_2H_4$ and phosphorus halides such as $PH_4I$, $PF_3$, $PF_5$, $PCl_3$, $PCl_5$, $PBr_3$, $PBr_5$, and $PI_3$ for introduction of phosphorus atoms. Other examples effectively applicable as a starting material for introduction of the Vb-atoms are $AsH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BiCl_3$, and $BiBr_3$. Among them, $PH_3$ diluted with hydrogen is most preferably used in terms of bringing out the effects of the present invention more effectively and handling.

For introducing halogen atoms into the photoconductive layer 103 in the present invention, preferred examples applicable as the source gas containing the halogen atoms include gas or gasifiable halogen compounds such as halogen gases, halides, interhalogen compounds containing halogen atoms, or halogen-substituted silane derivatives. In addition, further examples effectively applicable are gas or gasifiable, halogen-containing, silicon hydride compounds comprised of constituents of silicon atoms and halogen atoms. Specific examples of the halogen compounds preferably applicable in the present invention are fluorine gas ($F_2$) and the interhalogen compounds such as BrF, ClF, $ClF_3$, $BrF_3$, $BrF_5$, $IF_3$, and $IF_7$. Specific examples of the silicon compounds containing halogen atoms, i.e., the so-called, halogen-substituted silane derivatives, preferably applicable are silicon fluorides such as $SiF_4$ and $Si_2F_6$.

Further, the present invention is also valid when the photoconductive layer 103 contains at least one species selected from the group consisting of carbon atoms, oxygen atoms, and nitrogen atoms. However, a content of the at least one species selected from the group consisting of carbon atoms, oxygen atoms, and nitrogen atoms should be controlled desirably to $1\times10^{-5}$ to 10 atomic % with respect to the sum of silicon atoms, carbon atoms, oxygen atoms, and nitrogen atoms. The carbon atoms, oxygen atoms, and nitrogen atoms may be distributed all around and uniformly in the photoconductive layer or may have a portion with nonuniform distribution to change contents thereof in the direction of thickness of the photoconductive layer.

In the present invention, the thickness of the photoconductive layer 103 is determined properly according to requirements in terms of capability of achieving desired electrophotographic characteristics, economical effect, and so on, and the thickness is preferably between 20 and 50 $\mu$m, more preferably between 23 and 45 $\mu$m, and most preferably between 25 and 40 $\mu$m.

For making the photoconductive layer 103 with desired film characteristics as achieving the objects of the present invention, it is necessary to properly set the gas pressure inside the reaction vessel and the temperature of the substrate from total viewpoints including the mixture ratio of source gas and dilution gas and the discharge power.

As for the gas pressure in the reaction vessel, the optimum range thereof is also selected properly according to the layer design, and it is normally between $1\times10^{-4}$ and 10 Torr, preferably between $5\times10^{-4}$ and 5 Torr, and most preferably between $1\times10^{-3}$ and 1 Torr.

Further, the optimum range of the temperature of the substrate 101 is selected properly according to the layer design and normally, it is preferably between 200 and 350° C., more preferably between 230 and 330° C., and most preferably between 250 and 310° C.

In the present invention, desired numerical ranges of the temperature of substrate and the gas pressure for forming the photoconductive layer are those described above, but the conditions are not determined independently of each other in usual cases. Optimum values of the conditions are desirably determined based on mutual and organic relation so as to form the light receiving member having the desired characteristics.

(Surface layer)

In the present invention, it is essential that an amorphous silicon-based surface layer 104 be formed further on the photoconductive layer 103 which is formed on the substrate 101 as described above. This surface layer 104 has a free surface and is provided for achieving the objects of the present invention mainly in water repellency, moisture resistance, continuous and repetitive operation characteristics, withstand voltage (dielectric strength), operation environment characteristics, and durability.

Since in the present invention each of amorphous materials for respectively making the photoconductive layer 103 and the surface layer 104 constituting the light receiving layer 102 has the common constituent of silicon atom, chemical stability is fully assured at the interface between the stacked layers.

Preferred materials for the surface layer 104 are amorphous materials containing silicon atoms, carbon atoms, and hydrogen atoms (H) and/or halogen atoms (X) (hereinafter referred to as "a-SiC: H, X"), amorphous materials containing silicon atoms, oxygen atoms, and hydrogen atoms (H) and/or halogen atoms (X) (hereinafter referred to as "a-SiO: H, X"), amorphous materials containing silicon atoms, nitrogen atoms, and hydrogen atoms (H) and/or halogen atoms (X) (hereinafter referred to as "a-SiN: H, X"), and so on. In addition, other preferred materials are amorphous materials containing silicon atoms, at least two selected from the group consisting of carbon atoms, oxygen atoms, and nitrogen atoms, and hydrogen atoms (H) and/or halogen atoms (X). The above materials are generally called hereinafter as "a-SiCON: H, X".

In the present invention, for effectively achieving the objects thereof, the surface layer 104 is made by the vacuum deposit producing method while the numerical conditions of film-forming parameters are properly set so as to obtain desired characteristics. Specifically, the surface layer may be made by a variety of thin-film deposition methods, for example, including the glow discharge methods (the AC discharge CVD processes such as the low-frequency CVD process, high-frequency CVD process, or microwave CVD process, the DC discharge CVD process, and the like), the sputtering process, the vacuum vapor deposition process, the ion plating process, the optical CVD process, and the thermal CVD process. One of these thin-film deposition methods is properly selected and employed depending upon such factors as production conditions, loads under capital investment on facilities, production scale, and desired characteristics for the light receiving member for electrophotography fabricated, but, in view of productivity of light receiving member, a preferred method is the same deposition method as for the photoconductive layer.

For example, for making the surface layer 104 of a-SiC: H, X by the glow discharge process, basically, the source gas for supply of Si capable of supplying silicon atoms (Si), the source gas for supply of C capable of supplying carbon atoms (C), the source gas for supply of H capable of supplying hydrogen atoms (H), and/or the source gas for supply of X capable of supplying halogen atoms (X) are introduced in a desired gas state into the reaction vessel the internal pressure of which can be reduced, glow discharge is made to take place in the reaction vessel, and the layer of a-SiC: H, X is made on the substrate 101 on which the photoconductive layer 103 is preliminarily made at the predetermined position, as controlling the discharge power as described above.

The surface layer used in the present invention can be preferably made of a compound with silicon containing at least one element selected from carbon, nitrogen, and oxygen and particularly preferably made of one containing a-SiC as a main ingredient.

When the surface layer contains a-SiC as a main ingredient, a content of carbon is preferably in the range of 30% to 90% against the sum of silicon atoms and carbon atoms.

In the present invention the surface layer 104 needs to contain hydrogen atoms and/or halogen atoms, which are necessary and indispensable for compensating for the dangling bonds of silicon atoms and for improving the quality of layer, particularly for improving the photoconductive characteristics and charge holding characteristics. A content of hydrogen is desirably determined to be normally 30 to 70 atomic %, preferably 35 to 65 atomic %, and most preferably 40 to 60 atomic % with respect to the total amount of constituent atoms. A content of fluorine atoms is desirably determined to be normally 0.01 to 15 atomic %, preferably 0.1 to 10 atomic %, and most preferably 0.6 to 4 atomic %.

The light receiving members fabricated in the ranges of these hydrogen and/or fluorine contents are much more excellent than ever in practical aspect and can be applied well. Namely, it is known that the defects existing in the surface layer (mainly, dangling bonds of silicon atoms or carbon atoms) negatively affect the characteristics of the light receiving member for electrophotography. Examples of the negative effects are as follows: degradation of charging characteristics due to injection of charge from the free surface; change of charging characteristics due to change of surface structure under the operating circumstances, for example, under high humidity; occurrence of ghost phenomenon during repetitive operations because charges are injected into the surface layer from the photoconductive layer upon corona charging or upon light irradiation to be trapped by the defects in the surface layer, and so on.

However, when the hydrogen content in the surface layer is controlled to not less than 30 atomic %, the defects in the surface layer are reduced greatly, so that breakthrough improvements can be made in electrical characteristics and in quick continuous operability.

On the other hand, if the hydrogen content in the surface layer is not less than 71 atomic %, the hardness of the surface layer will be lowered, so that the surface layer might become undurable against repetitive use in some cases. Accordingly, the control of the hydrogen content in the surface layer within the aforementioned range is desired for achieving the extremely excellent, desired, electrophotographic characteristics. The hydrogen content in the surface layer can be controlled, for example, by the flow rate of $H_2$ gas, the temperature of the substrate, the discharge power, the gas pressure, or the like.

The control of the fluorine content in the surface layer within the range of not less than 0.01 atomic % makes it possible to more effectively achieve generation of bond of silicon atom and carbon atom in the surface layer. Further, the function of the fluorine atoms in the surface layer is to effectively prevent disconnection of bond of silicon atom and carbon atom due to damage of corona or the like.

On the other hand, when the fluorine content in the surface layer becomes over 15 atomic %, the effect of generation of bond of silicon atom and carbon atom in the surface layer and the effect to prevent disconnection of bond of silicon atom and carbon atom due to the damage of corona or the like can rarely be recognized. Further, since excessive fluorine atoms impede mobility of carriers in the surface layer, it might make the residual potential or image memory outstanding in some cases. Accordingly, controlling the fluorine content in the surface layer within the aforementioned range is preferred for achieving the desired electrophotographic characteristics. The fluorine content in the surface layer can be controlled, for example, by the flow rate of $H_2$ gas, the temperature of the substrate, the discharge power, the gas pressure, or the like, as the hydrogen content can.

Effectively applicable substances as the gas for supply of silicon (Si) used in the formation of the surface layer of the present invention include gas or gasifiable silicon hydrides (silanes) such as $SiH_4$, $Si_2H_6$, $Si_3H_8$, or $Si_4H_{10}$ among which $SiH_4$ and $Si_2H_6$ are preferable in terms of ease to handle upon production of layer, high supply efficiency of Si, and so on. These source gases for supply of Si may be used as diluted with a gas such as $H_2$, He, Ar, or Ne with necessity.

Substances effectively applicable as the gas for supply of carbon are gas or gasifiable hydrocarbons such as $CH_4$, $C_2H_6$, $C_3H_8$, and $C_4H_{10}$ and particularly preferred substances are $CH_4$ and $C_2H_6$ in terms of ease to handle upon production of the layer, high supply efficiency of C, and so on. These source gases for supply of C may be used as diluted with a gas such as $H_2$, He, Ar, or Ne with necessity.

Substances effectively applicable as the gas for supply of nitrogen or oxygen are gas or gasifiable compounds such as $NH_3$, NO, $N_2O$, $NO_2$, $O_2$, CO, $CO_2$, and $N_2$. These source gases for supply of nitrogen or oxygen may be used as diluted with a gas such as $H_2$, He, Ar, or Ne with necessity.

For further facilitating control of introduction ratio of hydrogen atoms introduced into the surface layer 104 to be formed, it is preferred to form the layer by mixing these gases further with a desired amount of hydrogen gas or a gas of silicon compound containing hydrogen atoms. Each gas may be a mixture of plural species at a predetermined mixture ratio without having to be limited to the single species.

Preferred examples effectively applicable as the source gas for supply of halogen atoms include gas or gasifiable halogen compounds such as halogen gases, halides, interhalogen compounds containing halogen atoms, or halogen-substituted silane derivatives. In addition, further examples effectively applicable are gas or gasifiable, halogen-containing, silicon hydride compounds comprised of constituents of silicon atoms and halogen atoms. Specific examples of the halogen compounds preferably applicable in the present invention are fluorine gas ($F_2$) and the interhalogen compounds such as BrF, ClF, $ClF_3$, $BrF_3$, $BrF_5$, $IF_3$, and $IF_7$. Specific examples of the silicon compounds containing halogen atoms, i.e., the so-called, halogen-substituted silane derivatives, preferably applicable are silicon fluorides such as $SiF_4$ and $Si_2F_6$.

An amount of hydrogen atoms and/or halogen atoms contained in the surface layer 104, may be controlled, for example, by controlling the temperature of substrate 101, an amount of the raw-material substance used for introduction of the hydrogen atoms and/or halogen atoms into the reaction vessel, the discharge power, or the like.

The carbon atoms and/or the hydrogen atoms and/or the nitrogen atoms may be contained in a uniformly distributed state all around in the surface layer or may be contained in a nonuniformly distributed state in some portions with changing contents in the direction of film thickness of the surface layer.

Further, in the present invention the surface layer 104 preferably contains the atoms for controlling the conductivity type as occasion may demand. The atoms for controlling the conductivity type may be contained in a uniformly distributed state all around in the surface layer 104 or may be contained in a nonuniformly distributed state in some portions in the direction of film thickness.

The aforementioned atoms for controlling the conductivity can be selected from the IIIb-atoms or the Vb-atoms as listed in the description of the photoconductive layer.

A content of the atoms for controlling the conductivity type, contained in the surface layer 104, is desirably determined to be preferably $1\times10^{-3}$ to $1\times10^{3}$ atomic ppm, more preferably $1\times10^{-2}$ to $5\times10^{2}$ atomic ppm, and most preferably $1\times10^{-1}$ to $1\times10^{2}$ atomic ppm. For structurally introducing the atoms for controlling conductivity type, for example, the IIIb-atoms or the Vb-atoms, into the surface layer, the raw-material substance for introduction of the IIIb-atoms or the raw-material substance for introduction of the Vb-atoms may be introduced in a gas state together with the other gas for making the surface layer 104 into the reaction vessel, upon formation of layer. The raw-material substance for introduction of the IIIb-atoms or the raw-material substance for introduction of the Vb-atoms is desirably selected from those existing in a gas state at ordinary temperature and under ordinary pressure and those that can be gasified readily at least under the conditions for forming the layer, as described previously.

These raw-material substances for introduction of the atoms for controlling conductivity type may be used as diluted with a gas such as $H_2$, He, Ar, or Ne with necessity.

The thickness of the surface layer 104 in the present invention is desirably determined to be normally 0.01 to 3 $\mu$m, preferably 0.05 to 2 $\mu$m, and most preferably 0.1 to 1 $\mu$m. If the thickness is smaller than 0.01 $\mu$m, the surface layer will be lost because of abrasion or the like during use of the light receiving member. If the thickness is over 3 $\mu$m, degradation of the electrophotographic characteristics, such as an increase in residual potential, will result.

The surface layer 104 according to the present invention is made carefully so that the required characteristics thereof can be imparted thereto as desired. Namely, substances including the components of Si, at least one selected from the group consisting of C, N, and O, and H and/or X exhibit a variety of properties depending upon their fabrication conditions; structural properties of from crystal to amorphous state, electro-physical properties of from the electrically conductive property to the semiconductive or electrically insulative property, and properties of from the photoconductive property to the non-photoconductive property. In the present invention, selection of the fabrication conditions is made strictly according to the desire so as to fabricate a compound having desired characteristics according to the purpose.

For example, if the surface layer 104 is provided for the principal purpose of an improvement in dielectric strength, it will be made of a non-monocrystal material showing noticeable, electrical insulation behavior under operation circumstances.

When the surface layer 104 is provided for the principal purpose of an improvement in continuous and repetitive operation characteristics or in operation circumstance characteristics, it may be made of a non-monocrystal material showing a somewhat relieved degree of the above electric insulation property and having some sensitivity to the light of irradiation.

For making the surface layer 104 with the characteristics capable of achieving the objects of the present invention, it is necessary to properly set the temperature of the substrate 101 and the gas pressure in the reaction vessel in accordance with the desire.

The optimum range of the temperature (Ts) of the substrate 101 is properly selected according to the layer design and in the normal case, it is preferably between 200 and 350° C., more preferably between 230 and 330° C., and most preferably between 250 and 310° C.

The optimum range of the gas pressure in the reaction vessel is also properly selected similarly according to the layer design and in the normal case, it is preferably between $1\times10^{-4}$ and 10 Torr, more preferably between $5\times10^{-4}$ and 5 Torr, and most preferably between $1\times10^{-3}$ and 1 Torr.

In the present invention, desired numerical ranges of the temperature of substrate and the gas pressure for forming the surface layer are those described above, but the conditions are not determined independently of each other in usual cases. Optimum values of the conditions are desirably determined based on mutual and organic relation so as to form the light receiving member having the desired characteristics.

In the present invention, addition of a blocking layer (lower surface layer) having a smaller content of carbon atoms, oxygen atoms, and nitrogen atoms than in the surface layer between the photoconductive layer and the surface layer is effective in further enhancing the characteristics such as chargeability or the like.

It is also permissible to provide a region with decreasing contents of at least one species selected from the group consisting of carbon atoms, oxygen atoms, and nitrogen atoms toward the photoconductive layer 103 between the surface layer 104 and the photoconductive layer 103. This can enhance adhesion between the surface layer 104 and the photoconductive layer 103, thereby further decreasing the influence of interference due to reflection of light at the interface.

(Charge injection preventing layer)

In the light receiving member for electrophotography according to the present invention, the effect is more enhanced by providing the charge injection preventing layer 105 functioning to prevent injection of charge from the conductive substrate 101 side, between the conductive substrate 101 and the photoconductive layer 103. Namely, the charge injection preventing layer 105 has a function to prevent the charge from being injected from the substrate 101 to the photoconductive layer 103 when the light receiving layer 102 is subjected to charging of a fixed polarity on the free surface thereof, and it has so-called polarity dependence that the function does not take place when the light receiving layer is subjected to charging of the opposite polarity. For providing the charge injection preventing layer with this function, the charge injection preventing layer 105 contains a relatively larger amount of atoms for controlling conductivity type than the photoconductive layer 103 does.

The atoms for controlling conductivity type in the preventing layer may be distributed all around and uniformly in the layer, or some portions may contain the atoms in a nonuniformly distributed state though containing them all around in the direction of film thickness. In the case of the nonuniform distribution of concentration, a preferred distribution is one containing the atoms distributed more on the substrate side.

In either case, however, the atoms need to be distributed uniformly and all around in the in-plane direction parallel to the surface of substrate in order to uniform the characteristics in the in-plane direction.

The charge injection preventing layer 105 may also contain the IIIb-atoms or the Vb-atoms for controlling conductivity type.

In the present invention, a content of the atoms, contained in the charge injection preventing layer, for controlling conductivity type, is properly determined as desired to effectively achieve the objects of the present invention, which is desirably determined to be preferably 10 to $1\times10^{4}$ atomic ppm, more preferably 50 to $5\times10^{3}$ atomic ppm, and most preferably $1\times10^{2}$ to $1\times10^{3}$ atomic ppm.

Further, when the charge injection preventing layer contains at least one species of carbon, nitrogen, and oxygen, adherence can be enhanced further to another layer provided in direct contact with the charge injection preventing layer.

At least one species selected from the group consisting of carbon atoms, nitrogen atoms, and hydrogen atoms contained in the layer may be distributed all around and uniformly in the layer, or some portions may contain them in a nonuniformly distributed state in the direction of film thickness. In either case, however, the atoms need to be distributed uniformly and all around in the in-plane direction parallel to the surface of substrate in order to uniform the characteristics in the in-plane direction.

A content of at least one species selected from the group consisting of carbon atoms, nitrogen atoms, and oxygen atoms contained in the entire region of the charge injection preventing layer in the present invention is preferably determined so as to effectively achieve the objects of the present invention, and is desirably determined to be preferably $1\times10^{-3}$ to 50 atomic %, more preferably $5\times10^{-3}$ to 30 atomic %, and most preferably $1\times10^{-2}$ to 10 atomic %, each of which, in the case of one species, is a content thereof or each of which, in the case of two or more species, is the sum of their contents.

Hydrogen atoms and/or halogen atoms contained in the charge injection preventing layer compensate for the dangling bonds present in the layer and are thus effective in improving the quality of film. A content of the hydrogen atoms or the halogen atoms or a total content of the hydrogen atoms and halogen atoms in the charge injection preventing layer is desirably determined to be preferably 1 to 50 atomic %, more preferably 5 to 40 atomic %, and most preferably 10 to 30 atomic %.

In the present invention the film thickness of the charge injection preventing layer is desirably determined to be preferably 0.1 to 5 $\mu$m, more preferably 0.3 to 4 $\mu$m, and most preferably 0.5 to 3 $\mu$m in order to achieve the desired electrophotographic characteristics, economical effect, and so on.

In the present invention, the charge injection preventing layer is formed by the same vacuum deposition method as in the formation of the photoconductive layer described above.

For forming the charge injection preventing layer 105 with the characteristics capable of achieving the objects of the present invention, it is necessary to properly set a mixture ratio of the gas for supply of Si and the dilution gas, the gas pressure in the reaction vessel, the discharge power, and the temperature of the substrate 101, as in the case of the photoconductive layer 103.

The optimum range of flow rate of $H_2$ and/or He as being the dilution gas is properly selected according to the design of layer, but a desired example is such that $H_2$ and/or He is controlled against the gas for supply of Si normally in the range of 1 to 20 times, preferably in the range of 3 to 15 times, and most preferably in the range of 5 to 10 times.

The optimum range of the gas pressure is also properly selected according to the design of layer, but a desired example is such that the gas pressure is normally in the range of $1\times10^{-4}$ to 10 Torr, preferably in the range of $5\times10^{-4}$ to 5 Torr, and most preferably in the range of $1\times10^{-3}$ to 1 Torr.

The optimum range of the discharge power is also properly selected according to the design of layer, but a desired example is such that the discharge power is set against the flow rate of the gas for supply of Si normally in the range of 1 to 7 W/sccm, preferably in the range of 2 to 6 W/sccm, and most preferably in the range of 3 to 5 W/sccm.

Further, the optimum range of the temperature of the substrate 101 is selected properly according to the layer design and in the normal case, it is preferably between 200 and 350° C., more preferably between 230 and 330° C., and most preferably between 250 and 310° C.

In the present invention, the above-stated ranges are desired numerical ranges of the mixture ratio of dilution gas, the gas pressure, the discharge power, and the temperature of substrate for making the charge injection preventing layer 105, but usually, these layer making factors are not determined independently of each other. An optimum value of each layer making factor is desirably determined based on mutual and organic relationship so as to make the charge injection preventing layer 105 with desired characteristics.

In addition, the light receiving member for electrophotography according to the present invention is preferably arranged to have a layer region containing a nonuniform distribution of at least aluminum atoms, silicon atoms, and hydrogen atoms and/or halogen atoms in the direction of film thickness on the substrate 101 side in the light receiving layer 102.

For the purpose of further improving the adhesion between the substrate 101 and the photoconductive layer 103 or the charge injection preventing layer 105, the light receiving member for electrophotography according to the present invention may be provided with an adhesive layer constituted of, for example, $Si_3N_4$, $SiO_2$, SiO, or an amorphous material containing hydrogen atoms and/or halogen atoms, and carbon atoms and/or oxygen atoms and/or nitrogen atoms in the matrix of silicon atoms. Further, it may be provided with a light absorbing layer for preventing occurrence of interference patterns due to reflected light from the substrate.

Next, the apparatus and film forming method for making the light receiving layer will be described in detail.

Figure 6:
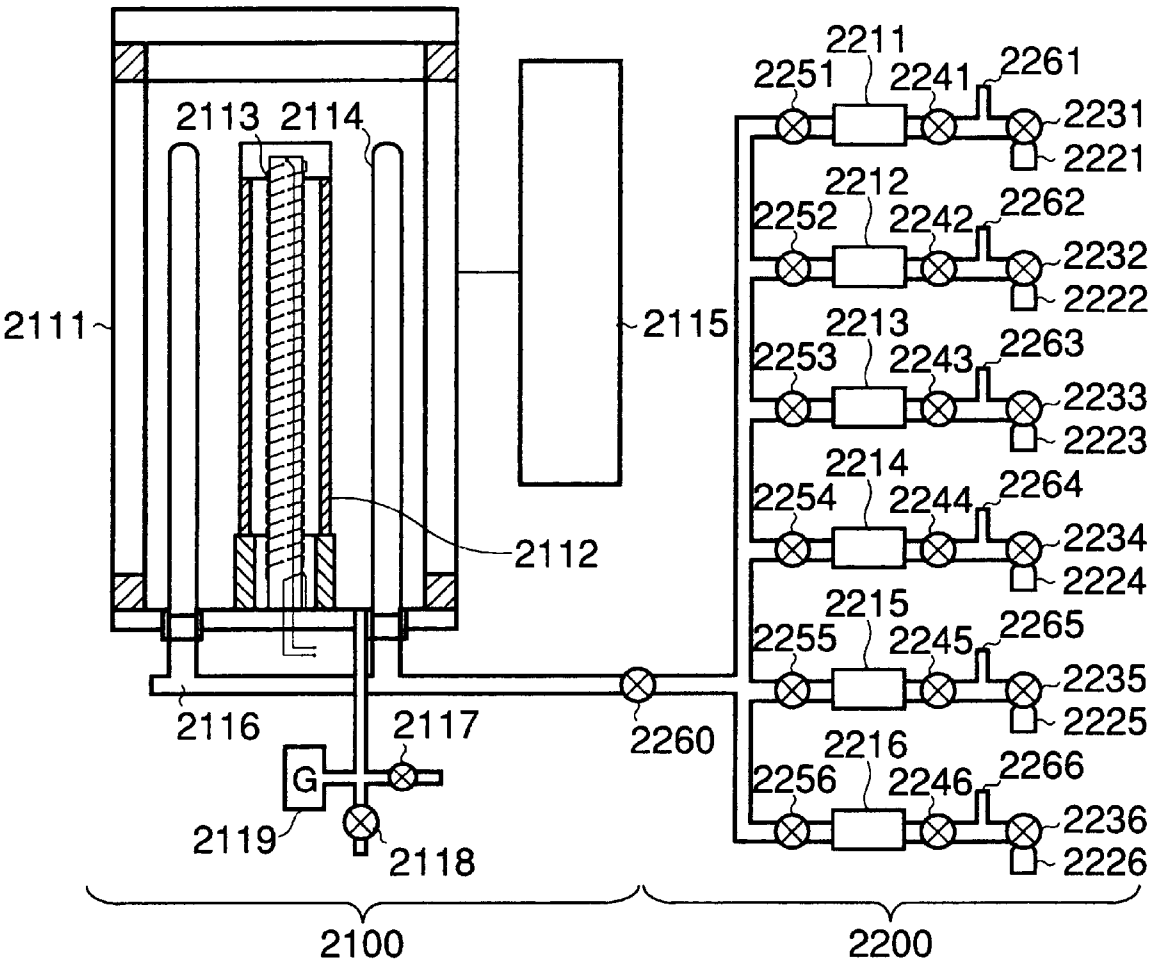
FIG. 6 is a schematic, structural view for explaining an example of an apparatus for fabricating the light receiving member for electrophotography.

FIG. 6 is a schematic, structural view to show an example of a fabrication system of the light receiving member for electrophotography by the radio-frequency plasma CVD process (hereinafter referred to as "RF-PCVD") using the frequency in the RF band. The construction of the fabrication system shown in FIG. 6 is as follows.

This system is composed mainly of a deposition apparatus (2100), a supply apparatus of source gases (2200), and an evacuation apparatus (not illustrated) for reducing the pressure inside the reaction vessel (2111). Installed inside the reaction vessel (2111) in the deposition apparatus (2100) are a cylindrical substrate (2112), a heater (2113) for heating the substrate, and source gas inlet pipes (2114), and further, a high-frequency matching box (2115) is connected thereto.

The source gas supply apparatus (2200) is composed of bombs (2221 to 2226) and valves (2231 to 2236, 2241 to 2246, 2251 to 2256) for source gases such as $SiH_4$, $GeH_4$, $H_2$, $CH_4$, $B_2H_6$, and $PH_3$, and mass flow controllers (2211 to 2216), and the bomb of each source gas is connected through a valve (2260) to the gas inlet pipes (2114) inside the reaction vessel (2111).

Fabrication of deposit film with this system can be carried out, for example, as follows.

First, the cylindrical substrate (2112) is set inside the reaction vessel (2111) and the inside of the reaction vessel (2111) is evacuated by the evacuation apparatus (for example, a vacuum pump) not illustrated. Subsequently, the temperature of the cylindrical substrate (2112) is controlled at the predetermined temperature in the range of 200° C. to 350° C. by the heater (2113) for heating the substrate.

For letting the source gases for fabrication of deposit film flow into the reaction vessel (2111), after it is confirmed that the valves (2231 to 2236) of the gas bombs and a leak valve (2117) of the reaction vessel are closed and that the inflow valves (2241 to 2246), the outflow valves (2251 to 2256), and the auxiliary valve (2260) are opened, the main valve (2118) is first opened to evacuate the inside of the reaction vessel (2111) and gas pipes (2116).

Next, the auxiliary valve (2260) arid outflow valves (2251 to 2256) are closed when reading on a vacuum gage (2219) reaches approximately $5\times10^{-6}$ Torr.

After that, each gas is introduced from the gas bomb (2221 to 2226) with opening the valve (2231 to 2236) and the pressure of each gas is adjusted to 2 kg/cm$^2$ by a pressure regulator (2261 to 2266). Next, the inflow valve (2241 to 2246) is opened gradually to introduce each gas into the mass flow controller (2211 to 2216).

After completion of preparation for film formation as described above, each layer is made in the following procedures.

When the cylindrical substrate (2112) reaches the predetermined temperature, the auxiliary valve (2260) and necessary valves out of the outflow valves (2251 to 2256) are opened gradually to introduce predetermined gases from the gas bombs (2221 to 2226) through the gas inlet pipes (2114) into the reaction vessel (2111). Then the flow rate of each source gas is adjusted to the predetermined flow rate by the mass flow controller (2211 to 2216). On that occasion, opening of the main valve (2118) is adjusted as observing the vacuum gage (2119) so that the pressure inside the reaction vessel (2111) may be kept at the predetermined pressure of not more than 1 Torr. When the internal pressure becomes stable, RF power supply (not illustrated) of the frequency 13.56 MHz is set to desired power to introduce RF power through the high-frequency matching box (2115) into the reaction vessel (2111), thereby producing glow discharge therein. This discharge energy decomposes the source gases introduced into the reaction vessel, whereby a deposit film containing the main ingredient of silicon as desired is made on the cylindrical substrate (2112). After the deposit film is made in a desired film thickness, the supply of RF power is stopped, and the outflow valves are closed to stop the flow of gases into the reaction vessel, thus ending the fabrication of deposit film.

By repeating the same operation a plurality of times, the light receiving layer is made in the desired multilayer structure.

It is a matter of course that all outflow valves except for gases necessary for making each layer are closed. In order to avoid the gases from remaining in the reaction vessel (2111) and in the pipes from the outflow valves (2251 to 2256) to the reaction vessel (2111), the operation for evacuating the inside of the system once to a high vacuum is carried out as occasion may demand, by closing the outflow valves (2251 to 2256), opening the auxiliary valve (2260), and further fully opening the main valve (2118).

To rotate the substrate (2112) at a predetermined speed by a driving device (not illustrated) is also effective during the fabrication of layer, for uniforming the fabrication of film.

Further, it is a matter of course that the gas species and valve operations described above should be changed according to the fabrication conditions of each layer.

The heating method of substrate may be carried out by any heat generator of vacuum specifications and, more specifically, the heat generator is selected from electrical resistance heat generators such as a coil heater of sheathed heater, a plate-shaped heater, or a ceramic heater; thermal radiation lamp heat generators such as a halogen lamp or an infrared lamp; heat generators by heat exchange means with a thermal medium of liquid, gas, or the like, and so on. A material for the surface of the heating means can be selected from metals such as stainless steel, nickel, aluminum, or copper, ceramics, heat-resistant polymer resins, and so on. FIG. 6 shows an example of the coil heater.

In addition to the above, another applicable method is a method for preparing a vessel for dedicated use for heating separately from the reaction vessel, heating the substrate therein, and carrying the substrate therefrom into the reaction vessel with keeping it in a vacuum.

The details on how the constitution of the present invention was achieved will be described specifically with experiment examples, but it is noted that the present invention is by no means intended to be limited to these examples.

[Experiment Example 1]

Using the fabrication system of light receiving member for electrophotography by the RF-PCVD method shown in FIG. 6, the light receiving members comprised of the charge injection preventing layer, the photoconductive layer, and the surface layer were made under the conditions shown in Table 1 on a mirror-finished aluminum cylinder of the diameter of 80 mm.

At this time the photoconductive layer forming conditions were such that the mixture ratio (D/A) of source gas and dilution gas was fixed at 5 and the discharge power was changed. Changes of surface state of light receiving members fabricated were observed by microscopy, the height and pitch of unevenness of surface were measured, and the relation between them was checked. The volume of the discharge space at this time was about 17000 $cm^3$. The results are shown in Table 2.

TABLE 1

| | Charge injection preventing layer | Photoconductive layer | Surface layer |
|---|---|---|---|
| Gas species and flow rates | | | |
| $SiH_4$ [SCCM] | 120 | 200 | 15 |
| $H_2$ [SCCM] | 300 | 1000 | |
| $B_2H_6$ [ppm] (with respect to $SiH_4$) | 2000 | 0.5 | |
| NO [SCCM] | 30 | | |
| $CH_4$ [SCCM] | | | 800 |
| Temperature of substrate [° C.] | 290 | 290 | 290 |
| Internal pressure [Torr] | 0.5 | 0.5 | 0.5 |
| Power [W] | 500 | see Table 2 | 400 |
| Thickness [μm] | 3 | 30 | 0.5 |

TABLE 2

| Sample No. | Discharge power (W) | B1 | B2 | x | y | x/y |
|---|---|---|---|---|---|---|
| 1 | 160 | 0.8 | 0.009 | 0.07 | 100 | 0.0007 |
| 2 | 200 | 1.0 | 0.012 | 0.1 | 100 | 0.001 |
| 3 | 240 | 1.2 | 0.014 | 0.12 | 40 | 0.003 |
| 4 | 260 | 1.3 | 0.015 | 0.15 | 35 | 0.004 |
| 5 | 280 | 1.4 | 0.016 | 0.15 | 30 | 0.005 |
| 6 | 400 | 2.0 | 0.023 | 0.17 | 22 | 0.008 |

TABLE 2-continued

| Sample No. | Discharge power (W) | B1 | B2 | x | y | x/y |
|---|---|---|---|---|---|---|
| 7 | 600 | 3.0 | 0.035 | 0.17 | 18 | 0.009 |
| 8 | 900 | 4.5 | 0.053 | 0.1 | 10 | 0.01 |
| 9 | 1000 | 5.0 | 0.058 | 1.0 | 10 | 0.1 |
| 10 | 1200 | 6.0 | 0.071 | 1.0 | 3 | 0.3 |
| 11 | 1400 | 7.0 | 0.082 | 1.1 | 1 | 1.1 |

Experiment Example 2

The light receiving members composed of the charge injection preventing layer, the photoconductive layer, and the surface layer were fabricated under the same conditions shown in Table 1 as in Experiment Example 1 except that the volume of the discharge space was changed to about 20000 $cm^3$ by changing the internal diameter of the reaction vessel in the fabrication system of light receiving member for electrophotography by the RF-PCVD method shown in FIG. 6 in Experiment Example 1.

Changes of surface state of light receiving members fabricated were observed by microscopy in the same manner as in Experiment Example 1, the height and pitch of unevenness of surface were measured, and the relation between them was checked. The results are shown in Table 3.

TABLE 3

| Sample No. | Discharge power (W) | B1 | B2 | x | y | x/y |
|---|---|---|---|---|---|---|
| 12 | 160 | 0.8 | 0.008 | 0.03 | 120 | 0.00025 |
| 13 | 200 | 1.0 | 0.010 | 0.05 | 115 | 0.00043 |
| 14 | 240 | 1.2 | 0.012 | 0.10 | 100 | 0.001 |
| 15 | 260 | 1.3 | 0.013 | 0.12 | 50 | 0.0024 |
| 16 | 280 | 1.4 | 0.014 | 0.11 | 35 | 0.0031 |
| 17 | 400 | 2.0 | 0.020 | 0.13 | 25 | 0.0052 |
| 18 | 600 | 3.0 | 0.030 | 0.12 | 20 | 0.006 |
| 19 | 900 | 4.5 | 0.045 | 0.14 | 10 | 0.014 |
| 20 | 1000 | 5.0 | 0.050 | 0.15 | 3 | 0.05 |
| 21 | 1200 | 6.0 | 0.060 | 0.15 | 1.5 | 0.1 |
| 22 | 1400 | 7.0 | 0.070 | 0.15 | 1 | 0.15 |

[Experiment Example 3]

The light receiving members (Samples No. 1 to 22) fabricated in Experiment Examples 1 and 2 were mounted to an electrophotographic apparatus obtained by modifying the electrophotographic apparatus NP-6750 available from CANON INC., for the present experiment, and durability thereof against toner fusion was checked under the following conditions.

Figure 7:
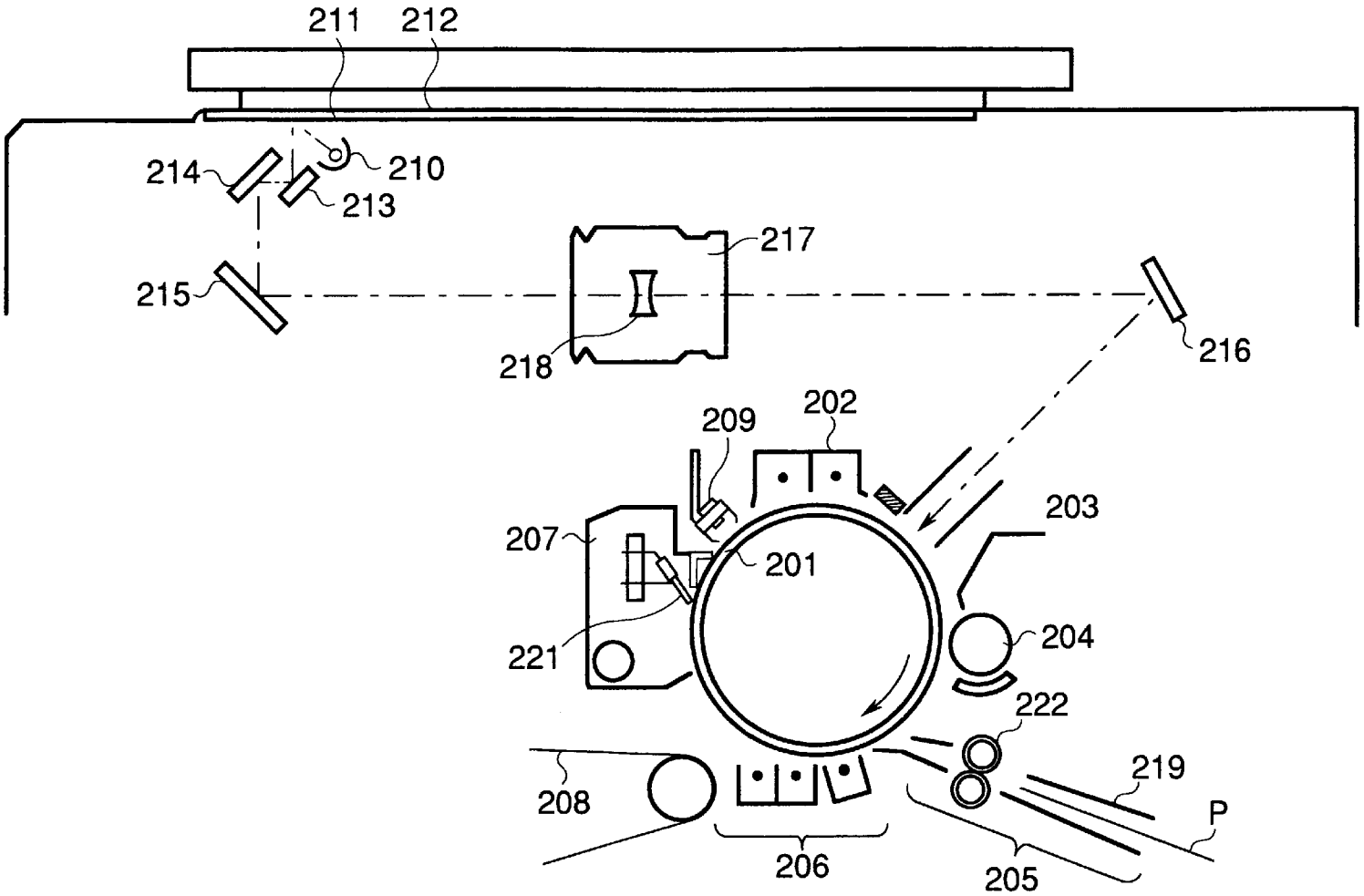
FIG. 7 is a schematic, cross-sectional, structural view for explaining an example of the schematic structure of the electrophotographic apparatus.

The schematic structure of the electrophotographic apparatus is as shown in FIG. 7 and image formation is carried out as described below.

In FIG. 7, reference numeral 201 denotes the light receiving member, 202 a primary charger, 203 an electrostatic latent image forming section, 204 a developing device, 205 a transfer medium supply system, 206 a transfer-separation charger, 207 a cleaner, 208 a transfer medium conveying system, 209 a charge eliminating light source, 210 a light source such as a halogen lamp or a fluorescent lamp, 211 a glass platen, 212 an original document, 213 to 216 a mirror system, 217 a lens system, 218 a filter, 219 a transfer medium path, 221 a cleaning blade, and 222 a registration roller.

The primary charger 202, exposure section, developing device 204, transfer medium supply system, transfer-separation charger 206, transfer medium discharge system, cleaner 207, and charge eliminating light source 209 are arranged along the rotation direction (as indicated by the arrow in the drawing) of the light receiving member 201 around the light receiving member 201.

The image formation is carried out in the following procedures.

First, the light receiving member 201 is rotated in the direction of the arrow and uniform corona charging is effected on the light receiving member by the primary charger 202. Light emitted from the light source 210 irradiates the original 212 on the glass platen 211 and the reflected light therefrom is guided via the mirror system 213 to 216, lens system 217, and filter 218 onto the surface of light receiving member to be projected thereonto and then to form an electrostatic latent image thereon. The toner is supplied from the developing device 204 onto this latent image to form a toner image.

On the other hand, in the gap between the transfer-separation charger 206 and the light receiving member 201, an electric field of the opposite polarity to that of the toner is imparted to the transfer medium P such as paper or plastics supplied through the transfer sheet supply system 205 comprised of the transfer sheet path 219 and registration roller 222 toward the light receiving member, whereby the toner image on the surface of light receiving member is transferred to the transfer medium P and the transfer medium is thus separated from the light receiving member 201 side.

The transfer medium P thus separated is guided through the transfer medium conveying system 208 to a fixing device (not illustrated), where the toner image is fixed. Then the transfer medium P is discharged out of the device.

The residual toner remaining on the surface of light receiving member without contributing to the transfer in the transfer section comes to the cleaner 207 and is cleaned off by the cleaning blade 221.

The surface of light receiving member renewed by the above cleaning is further subjected to charge elimination exposure to light from the charge eliminating light source 209 and again to the same cycle.

The modified apparatus was set under circumstances of the temperature 25° C. and the humidity 15%, the electric current of the primary charger, image exposure dose, etc. were adjusted so as to obtain appropriate images in the normal state, and the photosensitive member was rotated for ten hours without passage of sheet while supplying a constant amount of toner from the developing device to the photosensitive member. Particle diameters of toner used at this time were changed variously every experiment. However, melting points of toner used all were kept constant at about 160° C.

After stop of rotation, visual observation was conducted as to the status of residual toner adhering to the surface of photosensitive member and to the cleaning blade located downstream of the cleaning roller, and the side of the cleaning blade in contact with the surface of photosensitive member was observed with a microscope. Including presence or absence of burr-like portion, evaluation was made totally with the following criteria of judgment.

⊙: No fusion was observed.

○: Fine fusion was observed partly.

Δ: Fusion was observed partly.

The results are shown in Table 4. It is noted that values in the column of particle diameters of toner indicate relative values when the standard toner (average particle diameter 16 μm) is 100. The table also shows ratios of particle diameter of used toner to the height and to the pitch of unevenness on the surface of light receiving member (a/x, a/y: a=particle diameter of toner, x=height of unevenness, y=pitch of unevenness).

As apparent from Table 4, Samples No. 3–9 and 14–21 were excellent in durability against fusion with change of particle diameter of toner (especially, with toner of small particle diameter).

TABLE 4

| | Particle diameters of toner (relative values) | | | | |
|---|---|---|---|---|---|
| Sample No. | 120 (a/x, a/y) | 100 (a/x, a/y) | 80 (a/x, a/y) | 60 (a/x, a/y) | 40 (a/x, a/y) |
| 1 | ○ (274, 0.19) | ○ (229, 0.16) | Δ 183, 0.128) | Δ 137, 0.10) | Δ 91, 0.06) |
| 2 | ○ (192, 0.19) | ○ (160, 0.16) | ○ (128, 0.128) | Δ 96, 0.10) | Δ 64, 0.06) |
| 3 | ⊙ (160, 0.48) | ⊙ (133, 0.40) | ⊙ (107, 0.32) | ○ (80, 0.24) | ○ (53, 0.16) |
| 4 | ⊙ (128, 0.55) | ⊙ (107, 0.46) | ⊙ (85, 0.37) | ⊙ (64, 0.27) | ○ (43, 0.18) |
| 5 | ⊙ (128, 0.64) | ⊙ (107, 0.53) | ⊙ (85, 0.43) | ⊙ (64, 0.32) | ⊙ (43, 0.21) |
| 6 | ⊙ (113, 0.87) | ⊙ (94, 0.73) | ⊙ (75, 0.58) | ⊙ (56, 0.44) | ⊙ (38, 0.29) |
| 7 | ⊙ (113, 1.06) | ⊙ (94, 0.89) | ⊙ (75, 0.71) | ⊙ (56, 0.53) | ⊙ (38, 0.36) |
| 8 | ○ (192, 1.92) | ⊙ (160, 1.60) | ⊙ (128, 1.28) | ⊙ (96, 0.96) | ⊙ (64, 0.64) |
| 9 | ○ (19, 1.92) | ○ (16, 1.60) | ○ (13, 1.28) | ○ (10, 0.96) | ○ (6, 0.64) |
| 10 | Δ 19, 6.40) | Δ 16, 5.30) | 4 (13, 4.30) | Δ 10, 3.20) | Δ 6, 2.10) |
| 11 | Δ 18, 19.20) | Δ 15, 16.00) | Δ 12, 12.80) | Δ 9, 9.60) | Δ 6, 6.4) |
| 12 | Δ 640, 0.16) | Δ 533, 0.13) | Δ 427, 0.11) | Δ 320, 0.08) | Δ 213, 0.05) |
| 13 | Δ 384, 0.17) | ○ (320, 0.14) | ○ (256, 0.11) | ○ (192, 0.08) | Δ 128, 0.06) |
| 14 | ○ (192, 0.19) | ○ (160, 0.16) | ⊙ (128, 1.28) | ○ (96, 0.96) | ○ (64, 0.06) |
| 15 | ⊙ (160, 0.38) | ⊙ (133, 0.32) | ⊙ (107, 0.26) | ⊙ (80, 0.92) | ○ (53, 0.13) |
| 16 | ⊙ (175, 0.55) | ⊙ (145, 0.46) | ⊙ (116, 0.37) | ⊙ (87, 0.27) | ⊙ (58, 0.18) |
| 17 | ⊙ (148, 0.77) | ⊙ (123, 0.64) | ⊙ (98, 0.51) | ⊙ (74, 0.38) | ⊙ (49, 0.26) |
| 18 | ⊙ (160, 0.96) | ⊙ (133, 0.80) | ⊙ (107, 0.64 | ⊙ (80, 0.68) | ⊙ (53, 0.32) |
| 19 | ⊙ (137, 1.92) | ⊙ (114, 1.60) | ⊙ (91, 1.28) | ⊙ (69, 0.96) | ⊙ (46, 0.64) |
| 20 | ○ (128, 6.40) | ○ (107, 5.30) | ○ (85, 4.30) | ⊙ (64, 2.20) | ○ (43, 2.13) |
| 21 | Δ (128, 12.8) | ○ (107, 10.7) | ○ (85, 8.50) | Δ (64, 6.40) | Δ (43, 4.27) |
| 22 | Δ (128, 19.2) | Δ (107, 16.0) | Δ (85, 12.80) | Δ (64, 9.60) | Δ (43, 6.40) |

[Experiment Example 4]

The light receiving members (Samples No. 1 to 22) fabricated in Experiment Examples 1 and 2 were mounted to the electrophotographic apparatus obtained by modifying the electrophotographic apparatus NP-6750 available from CANON INC., for the present experiment, and durability thereof against toner fusion was checked under the following conditions.

The modified apparatus was set under circumstances of the temperature 25° C. and the humidity 15%, the electric current of the primary charger, image exposure dose, etc. were adjusted so as to obtain appropriate images in the normal state, and the photosensitive member was rotated for ten hours without passage of sheet while supplying a constant amount of toner from the developing device to the photosensitive member. Melting points of toner used at this time were changed variously every experiment. However, average particle diameters of toner used all were kept constant at about 16μm.

After stop of rotation, visual observation was conducted as to the status of residual toner adhering to the surface of photosensitive member and to the cleaning blade located downstream of the cleaning roller, and the side of the cleaning blade in contact with the surface of photosensitive member was observed with a microscope. Including presence or absence of burr-like portion, evaluation was made totally with the following criteria of judgment.

⊙: No fusion was observed.

○: Fine fusion was observed partly.

Δ: Fusion was observed partly.

The results are shown in Table 5. It is noted that values in the column of melting points of toner indicate relative values when the standard toner (melting point about 160° C.) is 100.

As apparent from Table 5, Samples No. 3–9 and 14–21 were excellent in durability against fusion with change of melting point of toner (especially, with toner of low melting point).

TABLE 5

| Sample | Melting points of toner (relative values) | | | | |
|---|---|---|---|---|---|
| No. | 120 | 100 | 80 | 70 | 60 |
| 1 | ○ | ○ | Δ | Δ | Δ |
| 2 | ⊙ | ○ | ○ | Δ | Δ |
| 3 | ⊙ | ⊙ | ⊙ | ○ | ○ |
| 4 | ⊙ | ⊙ | ⊙ | ⊙ | ○ |
| 5 | ⊙ | ⊙ | ⊙ | ⊙ | ⊙ |
| 6 | ⊙ | ⊙ | ⊙ | ⊙ | ⊙ |
| 7 | ⊙ | ⊙ | ⊙ | ⊙ | ⊙ |
| 8 | ⊙ | ⊙ | ⊙ | ⊙ | ⊙ |
| 9 | ○ | ○ | ⊙ | ⊙ | ○ |
| 10 | Δ | Δ | ○ | ○ | ○ |
| 11 | ○ | ○ | ○ | Δ | Δ |
| 12 | ○ | ○ | ○ | ○ | Δ |
| 13 | ○ | ○ | ○ | ○ | Δ |
| 14 | ⊙ | ⊙ | ⊙ | ○ | ○ |
| 15 | ⊙ | ⊙ | ⊙ | ⊙ | ○ |
| 16 | ⊙ | ⊙ | ⊙ | ⊙ | ⊙ |
| 17 | ⊙ | ⊙ | ⊙ | ⊙ | ⊙ |
| 18 | ⊙ | ⊙ | ⊙ | ⊙ | ⊙ |
| 19 | ⊙ | ⊙ | ⊙ | ⊙ | ⊙ |
| 20 | ⊙ | ⊙ | ⊙ | ⊙ | ○ |
| 21 | ○ | ○ | ○ | Δ | Δ |
| 22 | ○ | ○ | Δ | Δ | Δ |

[Experiment Example 5]

Using the fabrication system of light receiving member for electrophotography by the RF-PCVD method shown in FIG. 6, the light receiving members comprised of the charge injection preventing layer, the photoconductive layer, and the surface layer were made under the conditions shown in Table 1 on an aluminum cylinder of the diameter of 80 mm, in the same manner as in Experiment Examples 1 and 2.

At this time, by changing cutting conditions of aluminum cylinder variously, aluminum cylinders were made as providing the surface thereof with various unevenness in the range of height of unevenness of 0.05 to 4 μm and in the range of pitch of 2 to 200 μm. Changes of surface state of the light receiving members fabricated were observed by microscopy, the height and pitch of unevenness of surface were measured, and the relation between them was checked. After that, durability against fusion was checked with various toner materials different in average particle diameter and melting point in the same manner as in Experiment Examples 3 and 4.

As a result, when the unevenness by the recipe (the unevenness shown in Experiment Examples 1 and 2) was defined as first unevenness (the height of unevenness=x, the pitch of unevenness=y) and when the unevenness obtained by mechanically processing the surface of aluminum cylinder was defined as second unevenness (the height of unevenness=X, the pitch of unevenness=Y), the effects of the present invention were recognized more remarkably where the value of x/X was between 0.3 and 0.7 and the value of y/Y was between 0.1 and 0.3.

[Experiment Example 6]

Using the fabrication system of light receiving member for electrophotography by the RF-PCVD method shown in FIG. 6, the light receiving members comprised of the charge injection preventing layer, the photoconductive layer, and the surface layer were made under the conditions shown in Table 1 on a mirror-finished aluminum cylinder of the diameter of 80 mm, in the same manner as in Experiment Examples 1 and 2.

At this time, the light receiving members were fabricated under the same conditions as in Experiment Examples 1 and 2 except that the forming conditions of photoconductive layer were modified by changing the mixture ratio (D/A) of source gas and dilution gas in the range of 1 to 12. Changes of surface state of the light receiving members fabricated were observed by microscopy, the height and pitch of unevenness of surface were measured, and the relation between them was checked. After that, durability against fusion was checked with various toner materials different in average particle diameter and melting point in the same manner as in Experiment Examples 3 and 4.

As a result, good durability was presented in the range of D/A of 3 to 12, better durability was presented in the range of 3.5 to 8, and extremely excellent durability was presented in the range of 4 to 7.

[Experiment Example 7]

Using the fabrication system of light receiving member for electrophotography by the RF-PCVD method shown in FIG. 6, the light receiving members comprised of the charge injection preventing layer, the photoconductive layer, and the surface layer were made under the conditions shown in Table 6 on a mirror-finished aluminum cylinder of the diameter of 80 mm.

At this time, the light receiving members were fabricated in the same manner as in Experiment Example 1 except that the discharge power for formation of photoconductive layer was fixed at 600 W and that the discharge power for formation of surface layer was changed in the range of 100 to 800 W. Changes of surface state of the light receiving members fabricated were observed by microscopy, the height and pitch of unevenness of surface were measured, and the relation between them was checked. After that, durability against fusion was checked with various toner materials different in average particle diameter and melting point in the same manner as in Experiment Examples 3 and 4.

As a result, when a flow rate of source gas for introduction of carbon atoms and/or oxygen atoms and/or nitrogen atoms was defined as (F) and the discharge power as (H), the effects of the present invention were recognized especially remarkably where H/F was in the range of 0.2 to 0.3.

TABLE 6

| | Charge injection preventing layer | Photoconductive layer | Surface layer |
|---|---|---|---|
| Gas species and flow rates | | | |
| $SiH_4$ [SCCM] | 120 | 200 | 15 |
| $H_2$ [SCCM] | 300 | 1000 | |
| $B_2H_6$ [ppm] (with respect to $SiH_4$) | 2000 | 0.5 | |
| NO [SCCM] | 30 | | |
| $CH_4$ [SCCM] | | | 800 |
| Temperature of substrate [° C.] | 290 | 290 | 290 |
| Internal pressure [Torr] | 0.5 | 0.5 | 0.5 |
| Power [W] | 500 | 600 | 100–800 |
| Thickness [μm] | 3 | 30 | 0.5 |

The constituent requirements of the light receiving member of the present invention and the forming method of light receiving member of the present invention determined by Experiment Examples 1 to 7 as described above are summarized in Table 7 and Table 8.

TABLE 7

(Light receiving member)

| | Preferred range | Particularly preferred range | Optimum range |
|---|---|---|---|
| x/y | 0.001–0.1 | 0.002–0.08 | 0.003-0.05 |
| a/x | 30–200 | 40–180 | 50-150 |
| a/y | 0.1–3 | 0.2–2 | 0.3-1 |
| x | | 0.05–1 μm | |
| y | | 1–100 μm | |
| x/X | | 0.3–0.7 | |
| y/Y | | 0.1–0.3 | |

Notes: x=height of first unevenness, y=pitch of first unevenness, X=height of second unevenness, Y=pitch of second unevenness, a=average particle diameter of toner

TABLE 8

(Forming method)

| | Preferred range | Particularly preferred range | Optimum range |
|---|---|---|---|
| B1 | 1.2–6.0 | 1.3–5 | 1.4–4.5 |
| B2 | 0.01–0.06 | 0.01–0.05 | 0.01–0.03 |
| D/A | 3–10 | 3.5–8 | 4–7 |
| G | | 0.2–0.7 | |

Notes: B1=multiplier 1 upon formation of photoconductive layer, B2=multiplier 2 upon formation of photoconductive layer, D/A=mixture ratio of source gas and dilution gas, G=multiplier upon formation of surface layer

EXAMPLES

Specific examples for verifying the effects of the present invention will be described with examples and comparative examples, but it is noted that the present invention is by no means intended to be limited to these examples, nor to the above experiment examples.

Example 1

The light receiving member composed of the charge injection preventing layer, the photoconductive layer, and the surface layer (hereinafter referred to as a drum) was fabricated under the conditions shown in Table 9 on a mirror-finished aluminum cylinder of the diameter of 80 mm, using the fabrication system of light receiving member for electrophotography by the RF-PCVD method shown in FIG. 6, in the same manner as in Experiment Example 1.

In the present example, the modified apparatus from the electrophotographic apparatus NP-6750 available from CANON INC. was set under circumstances of the temperature 25° C. and the humidity 15%, the current value of primary charger etc. were adjusted so as to obtain an appropriate image in the normal state, and thereafter the power was interrupted to keep the apparatus still for 24 or m ore hours.

After that, the drum obtained was set in the above apparatus and images were formed by the ordinary electrophotographic process. Evaluation was then conducted on images after a durability test of forming a half million of images continuously (hereinafter simply referred to as a durability test) as to each item of "black dots", "white dots", "black lines", "image unevenness" or "image smearing".

Each of these items was evaluated by the following methods.

"Black dots": Evaluation was conducted in such a manner that the number of black dots having the diameter of not more than 0.2 mm was counted within the same area of copy images obtained by stacking ten white copy sheets on the original platen and performing copying thereof. Each evaluation was based on the following criteria.

◎: Very good
○: Good
Δ: Black dots were recognized in part.
×: Black dots were recognized over a relatively wide region.

"White dots": Evaluation was conducted in such a manner that the number of white dots having the diameter of not more than 0.2 mm was counted within the same area of copy images obtained by placing a totally black chart available from CANON INC. (part number: FY9-9073) on the original platen and performing copying thereof. Each evaluation was based on the following criteria.

◎: Very good
○: Good
Δ: White dots were recognized in part.
×: White dots were recognized over a relatively wide region.

"Black lines": Presence or absence of black line was checked by visual inspection for copy images obtained by placing a test chart available from CANON INC. (part number: FY9-9058) on the original platen and performing copying thereof. Each evaluation was based on the following criteria.

◎: Very good
○: Good
Δ: Black lines were recognized in part.
×: Black lines were recognized over a relatively wide region.

"Image unevenness": A density difference of image between portions where densities of the original were equal in the direction of from that side to this side of the photosensitive member was checked by visual inspection and a Macbeth reflection densitometer, for copy images obtained by placing the test chart available from CANON INC. (part number: FY9-9058) on the original platen and performing copying thereof. Each evaluation was based on the following criteria.

◎: Very good

○: Good

Δ: Image unevenness was recognized in part.

×: Image unevenness was recognized over a relatively wide region.

"Image smearing": For copy images obtained by placing the test chart including letters over the whole of a white surface, available from CANON INC., (part number: FY9-9058) on the original platen and performing copying under irradiation with a n exposure dose two times greater than normal, evaluation was conducted with the following four levels by visually observing whether thin lines on the image were continuous without break. When irregularity was observed on the image, evaluation was made for the worst portion in the entire image region.

◎: Good

○: Some breaks were present.

Δ: Break portions were rather many, but the letters were readable.

×: There were many break portions and some letters were not able to be read readily.

In all examples and comparative examples, the toner used in either one of evaluation tests was one having the relative value of 80 when the standard toner in the present invention (average particle diameter =about 16 μm, melting point= about 160° C.) was 100. The results are shown in Table 13.

TABLE 9

| | Charge injection preventing layer | Photoconductive layer | Surface layer |
|---|---|---|---|
| Gas species and flow rates | | | |
| $SiH_4$ [SCCM] | 120 | 200 | 15 |
| $H_2$ [SCCM] | 300 | 1000 | |
| $B_2H_6$ [ppm] (with respect to $SiH_4$) | 2000 | 0.5 | |
| NO [SCCM] | 30 | | |
| $CH_4$ [SCCM] | | | 800 |
| B1 | — | 2.0 | — |
| B2 | — | 0.023 | — |
| D/A | — | 5 | — |
| G | — | — | 0.5 |
| Temperature of substrate [° C.] | 290 | 290 | 290 |
| Internal pressure [Torr] | 0.5 | 0.5 | 0.5 |
| Power [W] | 500 | 400 | 400 |
| Thickness [μm] | 3 | 30 | 0.5 |

Comparative Example 1

The drum composed of the charge injection preventing layer, the photoconductive layer, and the surface layer was fabricated under the conditions shown in Table 10 on a mirror-finished aluminum cylinder of the diameter of 80 mm, using the fabrication system of light receiving member for electrophotography by the RF-PCVD method shown in FIG. 6, in the same manner as in Example 1 except that the forming conditions of photoconductive layer were outside the scope of the present invention.

The drum obtained was set in NP6750 and evaluation was conducted as to each item of "black dots", "white dots", "black lines", "image unevenness" or "image smearing" in the same manner as in Example 1. The results are shown in Table 13, together with the results of Example 1.

TABLE 10

| | Charge injection preventing layer | Photoconductive layer | Surface layer |
|---|---|---|---|
| Gas species and flow rates | | | |
| $SiH_4$ [SCCM] | 120 | 200 | 15 |
| $H_2$ [SCCM] | 300 | 1000 | |
| $B_2H_6$ [ppm] (with respect to $SiH_4$) | 2000 | 0.5 | |
| NO [SCCM] | 30 | | |
| $CH_4$ [SCCM] | | | 800 |
| B1 | — | 7.0 | — |
| B2 | — | 0.082 | — |
| D/A | — | 5 | — |
| G | — | — | 0.5 |
| Temperature of substrate [° C.] | 290 | 290 | 290 |
| Internal pressure [Torr] | 0.5 | 0.5 | 0.5 |
| Power [W] | 500 | 1400 | 400 |
| Thickness [μm] | 3 | 30 | 0.5 |

Comparative Example 2

The drum composed of the charge injection preventing layer, the photoconductive layer, and the surface layer was fabricated under the conditions shown in Table 11 on a mirror-finished aluminum cylinder of the diameter of 80 mm, using the fabrication system of light receiving member for electrophotography by the RF-PCVD method shown in FIG. 6, in the same manner as in Example 1 except that the forming conditions of photoconductive layer were outside the scope of the present invention (but were different conditions from those in Comparative Example 1).

The drum obtained was set in NP6750 and evaluation was conducted as to each item of "black dots", "white dots", "black lines", "image unevenness" or "image smearing" in the same manner as in Example 1. The results are shown in Table 13, together with the results of Example 1 and Comparative Example 1.

TABLE 11

| | Charge injection preventing layer | Photoconductive layer | Surface layer |
|---|---|---|---|
| Gas species and flow rates | | | |
| $SiH_4$ [SCCM] | 120 | 200 | 15 |
| $H_2$ [SCCM] | 300 | 1000 | |
| $B_2H_6$ [ppm] (with respect to $SiH_4$) | 2000 | 0.5 | |
| NO [SCCM] | 30 | | |
| $CH_4$ [SCCM] | | | 800 |
| B1 | — | 2.0 | — |
| B2 | — | 0.023 | — |
| D/A | — | 15 | — |
| G | — | — | 0.5 |
| Temperature of substrate [° C.] | 290 | 290 | 290 |
| Internal pressure [Torr] | 0.5 | 0.5 | 0.5 |
| Power [W] | 500 | 400 | 400 |
| Thickness [μm] | 3 | 30 | 0.5 |

Comparative Example 3

The drum composed of the charge injection preventing layer, the photoconductive layer, and the surface layer was fabricated under the conditions shown in Table 12 on a mirror-finished aluminum cylinder of the diameter of 80 mm, using the fabrication system of light receiving member for electrophotography by the RF-PCVD method shown in FIG. 6, in the same manner as in Example 1 except that the forming conditions of photoconductive layer were outside the scope of the present invention (but were different conditions from those in Comparative Examples 1 and 2).

The drum obtained was set in NP6750 and evaluation was conducted as to each item of "black dots", "white dots", "black lines", "image unevenness" or "image smearing" in the same manner as in Example 1. The results are shown in Table 13, together with the results of Example 1 and Comparative Examples 1 and 2.

TABLE 12

| | Charge injection preventing layer | Photoconductive layer | Surface layer |
|---|---|---|---|
| Gas species and flow rates | | | |
| $SiH_4$ [SCCM] | 120 | 200 | 15 |
| $H_2$ [SCCM] | 300 | 1000 | |
| $B_2H_6$ [ppm] (with respect to $SiH_4$) | 2000 | 0.5 | |
| NO [SCCM] | 30 | | |
| $CH_4$ [SCCM] | | | 800 |
| B1 | — | 2.0 | — |
| B2 | — | 0.023 | — |

TABLE 12-continued

| | Charge injection preventing layer | Photoconductive layer | Surface layer |
|---|---|---|---|
| D/A | — | 5 | — |
| G | — | — | 2.5 |
| Temperature of substrate [° C.] | 290 | 290 | 290 |
| Internal pressure [Torr] | 0.5 | 0.5 | 0.5 |
| Power [W] | 500 | 400 | 2000 |
| Thickness [μm] | 3 | 30 | 0.5 |

TABLE 13

| | Example 1 | Comp. Ex. 1 | Comp. Ex. 2 | Comp. Ex. 3 |
|---|---|---|---|---|
| Black dots | ◎ | ○ | ○ | Δ |
| White dots | ◎ | ○ | ○ | ○ |
| Black lines | ◎ | x | Δ | Δ |
| Image unevenness | ◎ | ○ | Δ | |
| Image smearing | ◎ | ○ | ○ | x |

As apparent from the results shown in Table 13, the drum according to the present invention has high durability against fusion and is thus excellent in image characteristics after the durability test.

Example 2

Using the fabrication system of light receiving member for electrophotography shown in FIG. 6, the drum was fabricated in different layer structure from that in Example 1 under the fabrication conditions shown in Table 14. The drum thus fabricated was subjected to the same evaluation tests as in Example 1 and it was confirmed that the drum excellent in image characteristics was obtained as in Example 1.

In the following tables, the arrows connecting two flow rate values show that the flow rate is changed from the left value to the right value with the elapse of time.

TABLE 14

| | Photoconductive layer | Surface layer |
|---|---|---|
| Gas species and flow rates | | |
| $SiH_4$ [SCCM] | 200 | 15 |
| $H_2$ [SCCM] | 1000 | |
| $B_2H_6$ [ppm] (with respect to $SiH_4$) | 8→0.2 | |
| $CH_4$ [SCCM] | | 800 |
| B1 | 2.0 | — |
| B2 | 0.023 | — |
| D/A | 5 | — |
| G | — | 0.5 |

TABLE 14-continued

| | Photoconductive layer | Surface layer |
|---|---|---|
| Temperature of substrate [° C.] | 290 | 290 |
| Internal pressure [Torr] | 0.5 | 0.5 |
| Power [W] | 400 | 400 |
| Thickness [μm] | 30 | 0.5 |

Example 3

Using the fabrication system of light receiving member for electrophotography shown in FIG. 6, the drum was fabricated in different layer structure from that in Example 1 under the fabrication conditions shown in Table 15. The drum thus fabricated was subjected to the same evaluation tests as in Example 1 and it was confirmed that the drum excellent in image characteristics was obtained as in Example 1.

TABLE 15

| | Charge injection preventing layer | Photoconductive layer | Surface layer |
|---|---|---|---|
| Gas species and flow rates | | | |
| $SiH_4$ [SCCM] | 200 | 100 | 100→5→2 |
| $CF_4$ [SCCM] | | | 5 |
| $H_2$ [SCCM] | 500 | 400 | |
| $B_2H_6$ [ppm] (with respect to $SiH_4$) | 1800 | 3 | |
| NO [SCCM] | 10 | | |
| $CH_4$ [SCCM] | 5 | | 0→500→800 |
| B1 | — | 4.0 | — |
| B2 | — | 0.023 | — |
| D/A | — | 4 | — |
| G | — | — | 0.4→0.25 |
| Temperature of substrate [° C.] | 300 | 300 | 200 |
| Internal pressure [mTorr] | 30 | 10 | 20 |
| Power [W] | 200 | 400 | 100 |
| Thickness [μm] | 2 | 30 | 0.5 |

Example 4

Using the fabrication system of light receiving member for electrophotography shown in FIG. 6, the drum was fabricated in different layer structure from that in Example 1 under the fabrication conditions shown in Table 16. The drum thus fabricated was subjected to the same evaluation tests as in Example 1 and it was confirmed that the drum excellent in image characteristics was obtained as in Example 1.

TABLE 16

| | | Photoconductive layer | | |
|---|---|---|---|---|
| | Charge injection preventing layer | Charge transport layer | Charge generation layer | Surface layer |
| Gas species and flow rates | | | | |
| $SiH_4$ [SCCM] | 150 | 300 | 300 | 300→15→5 |
| $H_2$ [SCCM] | 500 | 1800 | 1800 | |
| $B_2H_6$ [ppm] (with respect to $SiH_4$) | 2000 | 3 | 0.3 | |
| NO [SCCM] | 10 | | | 5 |
| $CH_4$ [SCCM] | | | | 0→500→800 |
| B1 | — | 3.3 | 2 | — |
| B2 | — | 0.058 | 0.035 | — |
| D/A | — | 6 | 6 | — |
| G | — | — | — | 0.4→0.25 |
| Temperature of substrate [° C.] | 250 | 270 | 300 | 280 |
| Internal pressure [Torr] | 0.3 | 0.5 | 0.3 | 0.5 |
| Power [W] | 200 | 1000 | 600 | 200 |
| Thickness [μm] | 3 | 25 | 3 | 0.5 |

Example 5

Using the fabrication system of light receiving member for electrophotography shown in FIG. 6, the drum was fabricated in different layer structure from that in Example 1 under the fabrication conditions shown in Table 17. The drum thus fabricated was subjected to the same evaluation tests as in Example 1 and it was confirmed that the drum excellent in image characteristics was obtained as in Example 1.

TABLE 17

| | Charge injection preventing layer | Photoconductive layer | Surface layer |
|---|---|---|---|
| Gas species and flow rates | | | |
| $SiH_4$ [SCCM] | 120 | 200 | 15 |
| $H_2$ [SCCM] | 300 | 1000 | |
| $B_2H_6$ [ppm] (with respect to $SiH_4$) | 2000 | 0.5 | |
| NO [SCCM] | 30 | | |
| $NH_3$ [SCCM] | | | 700 |
| B1 | — | 2.0 | — |
| B2 | — | 0.023 | — |
| D/A | — | 5 | — |
| G | — | — | 0.57 |
| Temperature of substrate [° C.] | 290 | 290 | 290 |
| Internal pressure [Torr] | 0.5 | 0.5 | 0.5 |

TABLE 17-continued

| | Charge injection preventing layer | Photoconductive layer | Surface layer |
|---|---|---|---|
| Power [W] | 500 | 400 | 400 |
| Thickness [μm] | 3 | 30 | 0.5 |

Example 6

Using the fabrication system of light receiving member for electrophotography shown in FIG. 6, the drum was fabricated in different layer structure from that in Example 1 under the fabrication conditions shown in Table 18. The drum thus fabricated was subjected to the same evaluation tests as in Example 1 and it was confirmed that the drum excellent in image characteristics was obtained as in Example 1.

As verified by the above examples, it was proved that the excellent effects of the present invention were independent of the layer structure of drum.

TABLE 18

| | Charge injection preventing layer | Photoconductive layer | Surface layer |
|---|---|---|---|
| Gas species and flow rates | | | |
| $SiH_4$ [SCCM] | 120 | 200 | 100 |
| $H_2$ [SCCM] | 300 | 1000 | |
| $B_2H_6$ [ppm] (with respect to $SiH_4$) | 2000 | 0.5 | |
| NO [SCCM] | 30 | | |
| $O_2$ [SCCM] | | | 200 |
| B1 | — | 2.0 | — |
| B2 | — | 0.023 | — |
| D/A | — | 5 | — |
| G | — | — | 0.5 |
| Temperature of substrate [° C.] | 290 | 290 | 290 |
| Internal pressure [Torr] | 0.5 | 0.5 | 0.5 |
| Power [W] | 500 | 400 | 100 |
| Thickness [μm] | 3 | 30 | 0.5 |

(Effects of the Invention)

As detailed above, the present invention can maintain good cleanability of the surface of light receiving member even in use of the low-melting-point toner or the small-particle-diameter toner. Accordingly, the present invention can achieve a breakthrough improvement in the quality of image and can keep excellent characteristics stably for a long period.

Specifically, even in the case of the lower-melting-point or smaller-particle-diameter toner being used, the durability against fusion of toner is improved and the image characteristics of white dots, black dots, black lines, image unevenness, image smearing, and the like can be maintained in a good order for a long period.

It is a matter of course that the present invention is not limited to the above examples, but it may be modified with necessity. For example, there are no specific limitations on the type of the charger in the electrophotographic apparatus as long as it can charge the surface of light receiving member. For example, any contact-type or non-contact-type charging means can be used. In addition, the cleaner does not always have to incorporate the blade thereinto. Without having to be limited to this, it can be modified or changed within the scope of the essence of the present invention.

What is claimed is:

1. An electrophotographic apparatus comprising a light receiving member for forming a latent image and means for supplying toner onto a surface of the light receiving member, wherein the surface of the light receiving member has unevenness to satisfy the following conditions:

$0.001 \leqq x/y \leqq 0.1$, $30 \leqq a/x \leqq 200$, and $0.1 \leqq a/y \leqq 3$, where x is a height of the unevenness of the surface, y is a pitch of the unevenness of the surface, and a is a particle diameter of the toner; and wherein the surface comprises 30–70 atomic % hydrogen atoms and at least one material selected from the group consisting of carbon atoms, oxygen atoms and nitrogen atoms.

2. The electrophotographic apparatus according to claim 1, wherein said x/y, a/x, and a/y each satisfy the following conditions:

$0.002 \leqq x/y \leqq 0.08$, $40 \leqq a/x \leqq 180$, and $0.2 \leqq a/y \leqq 2$.

3. The electrophotographic apparatus according to claim 1, wherein said x/y, a/x, and a/y each satisfy the following conditions:

$0.003 \leqq x/y \leqq 0.05$, $50 \leqq a/x \leqq 150$, and $0.3 \leqq a/y \leqq 1$.

4. The electrophotographic apparatus according to claim 1, wherein the height x of said unevenness and the pitch y of said unevenness are in the following ranges:

$0.05\ \mu m \leqq x \leqq 1\ \mu m$, and $1\ \mu m \leqq y \leqq 100 \mu m$.

5. The electrophotographic apparatus according to claim 1, wherein said unevenness further comprises another unevenness and the following conditions are satisfied:

$0.3 \leqq x/X \leqq 0.7$, and $0.1 \leqq y/Y \leqq 0.3$, where X is a height of said another unevenness and Y is a pitch of said another unevenness.

6. The electrophotographic apparatus according to claim 1, further comprising a cleaner for removing the toner on the surface of said light receiving member.

7. The electrophotographic apparatus according to claim 6, wherein said cleaner has a cleaning blade.

8. The electrophotographic apparatus according to claim 1, wherein the means for supplying the toner comprises a developing device.

9. The electrophotographic apparatus according to claim 1, wherein said surface further comprises halogen atoms.

10. The electrophotographic apparatus according to claim 9, wherein said non-monocrystal material is an amorphous material.

11. The electrophotographic apparatus according to claim 1, wherein the surface comprises carbon atoms and silicon atoms and wherein the number of carbon atoms is 30–90% of the number of carbon atoms and silicon atoms.

12. An image forming method, which comprises charging a surface of a light receiving member having unevenness in the surface, irradiating the charged surface with desired light to form a latent image therein, supplying toner onto the surface with the latent image formed therein to form an image on the surface of the light receiving member, wherein said unevenness satisfies the following conditions:

$0.001 \leqq x/y \leqq 0.1$, $30 \leqq a/x \leqq 200$, and $0.1 \leqq a/y \leqq 3$, where x is a height of the unevenness, y is a pitch of the unevenness, and a is a particle diameter of the toner; and wherein the surface comprises 30–70 atomic W hydrogen atoms and at least one material selected from the group consisting of carbon atoms, oxygen atoms and nitrogen atoms.

13. The image forming method according to claim 12, further comprising a removing step of removing unnecessary toner on said light receiving member after formation of said image.

14. The image forming method according to claim 13, wherein said removing step is carried out by moving a blade provided in contact with the surface of the light receiving member, relative to the light receiving member.

15. The image forming method according to claim 13, further comprising a step of transferring said image onto a transfer member after formation of said image and before said removing step.

16. The image forming method according to claim 12, wherein said surface further comprises halogen atoms.

17. The image forming method according to claim 12, wherein the surface comprises carbon atoms and silicon atoms and wherein the number of carbon atoms is 30–90% of the number of carbon atoms and silicon atoms.

18. A process for fabricating a light receiving member for electrophotography according to claim 1, said light receiving member comprising an electrically conductive substrate, a photoconductive layer showing a photoconductive property and comprising a non-monocrystal material containing hydrogen atoms or halogen atoms in the matrix of silicon atoms, wherein the surface of the light receiving member is provided by a surface layer comprising a non-monocrystal material containing silicon atoms and wherein said photoconductive layer is made so that when a flow rate of source gas is (A), multiplier 1 is (B1), discharge power is (C), a flow rate of dilution gas is (D), a volume of a discharge space is (E), and multiplier 2 is (B2), the factors (A), (B1), (B2), (C), (D), and (E) satisfy the following condition equations:

$C = A \times B1$, $C = E \times B2$, $1.2 \leqq B1 \leqq 6.0$, $0.01 \leqq B2 \leqq 0.06$, and $3 \leqq D/A \leqq 10$.

19. The process according to claim 18, wherein such control is made that the flow rate of source gas (A), the multiplier 1 (B1), the flow rate of dilution gas (D), the volume of the discharge space (E), and the multiplier 2 (B2) satisfy the following condition equations:

$1.3 \leqq B1 \leqq 5$, $0.01 \leqq B2 \leqq 0.05$, and $3.5 \leqq D/A \leqq 8$.

20. The process according to claim 18, wherein such control is made that the flow rate of source gas (A), the multiplier 1 (B1), the flow rate of dilution gas (D), the volume of a discharge space (E), and the multiplier 2 (B2) satisfy the following condition equations:

$1.4 \leqq B1 \leqq 4.5$, $0.01 \leqq B2 \leqq 0.03$, and $4 \leqq D/A \leqq 7$.

21. The process according to claim 18, wherein the dilution gas used for fabrication of said light receiving layer is $H_2$ and/or He gas introduced singly or by mixture.

22. The process according to claim 18, wherein at least one gas containing an element belonging to the IIIb group or the Vb group in the periodic table is introduced upon fabrication of said photoconductive layer.

23. The process according to claim 18, wherein a gas containing at least one of carbon, oxygen, and nitrogen elements is introduced singly or by mixture upon fabrication of said photoconductive layer.

24. The process according to claim 18, wherein in forming said surface layer, such control is made that when a flow rate of source gas for introduction of carbon atoms, oxygen atoms, or nitrogen atoms is (F), a multiplier is (G), and discharge power is (H), the factors (F), (G), and (H) satisfy the following condition equations:

$H = F \times G$, and $0.2 \leqq G \leqq 0.7$.

25. The process according to claim 18, wherein the thickness of said photoconductive layer is in the range of 20 to 50 $\mu$m.

26. The process according to claim 18, wherein the thickness of said surface layer is in the range of 0.01 to 3 $\mu$m.

* * * * *

UNITED STATES PATENT AND TRADEMARK OFFICE

CERTIFICATE OF CORRECTION

PATENT NO. : 5,943,531

DATED : August 24, 1999

INVENTOR(S) : YASUYOSHI TAKAI ET AL.

It is certified that error appears in the above-identified patent and that said Letters Patent is hereby corrected as shown below:

COLUMN 3

Line 22, "There thus occurred" should read --Accordingly, there were--.

COLUMN 5

Line 51, "make removal" should read --make its removal--.

COLUMN 7

Line 3, "0.05 $\mu$m $\leqq$ x $\leqq$ 5 $\mu$m" should read --0.05 $\mu$m $\leqq$ x $\leqq$ 1 $\mu$m-.

COLUMN 11

Line 67, delete "and handling".

COLUMN 20

Line 4, "arid" should read --and--.

COLUMN 23

Line 48, "every" should read --at every--;
Line 49, delete "all".

COLUMN 24

Line 67, "every" should read --at every--.

COLUMN 25

Line 1, delete "all".

UNITED STATES PATENT AND TRADEMARK OFFICE

CERTIFICATE OF CORRECTION

PATENT NO. : 5,943,531

DATED : August 24, 1999

INVENTOR(S) : YASUYOSHI TAKAI ET AL.

It is certified that error appears in the above-identified patent and that said Letters Patent is hereby corrected as shown below:

COLUMN 28

Line 21, "m" should read --more--;
Line 22, "ore" should be deleted.

COLUMN 29

Line 20, "a n" should read --an--.

COLUMN 37

Line 14, "W" should read --%--;
Line 45, "atoms and" should read --atoms, and--.

Signed and Sealed this

Twenty-sixth Day of September, 2000

*Attest:*

Q. TODD DICKINSON

*Attesting Officer*

*Director of Patents and Trademarks*